US010775724B1

(12) United States Patent
Nagata et al.

(10) Patent No.: US 10,775,724 B1
(45) Date of Patent: Sep. 15, 2020

(54) FIXING DEVICE AND IMAGE FORMING APPARATUS

(71) Applicant: FUJI XEROX CO., LTD., Tokyo (JP)

(72) Inventors: Yasushi Nagata, Kanagawa (JP); Yasutaka Gotoh, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/735,814

(22) Filed: Jan. 7, 2020

(30) Foreign Application Priority Data

May 20, 2019 (JP) ..... 2019-094796

(51) Int. Cl.
*G03G 15/20* (2006.01)

(52) U.S. Cl.
CPC ..... *G03G 15/2025* (2013.01); *G03G 2215/00531* (2013.01); *G03G 2215/2035* (2013.01)

(58) Field of Classification Search
CPC ..... G03G 15/2025; G03G 2215/00531; G03G 2215/2035
See application file for complete search history.

(56) References Cited

U.S. PATENT DOCUMENTS 7,391,984 B2 * 6/2008 Sugita ..... G03G 15/2025 399/327
2011/0268481 A1 11/2011 Tetsuno et al.
2011/0268482 A1 11/2011 Akamatsu et al.

FOREIGN PATENT DOCUMENTS

JP 10207280 A * 8/1998
JP 2003-057985 A 2/2003
JP 2011-232689 A 11/2011
JP 2011-232690 A 11/2011

* cited by examiner

*Primary Examiner* — Susan S Lee
(74) *Attorney, Agent, or Firm* — Sughrue Mion, PLLC

(57) ABSTRACT

A fixing device includes: a first pressing unit that rotates; a second pressing unit that comes into press-contact with the first pressing unit to form a nip portion at which a toner image is fixed on a recording medium; a heating unit that heats at least one of the first and second pressing units; and a first cleaning unit that comes into contact with a surface of at least one of the first and second pressing units to perform cleaning, the fixing device being configured to perform a high-temperature rotating operation that includes rotating the first or second pressing unit and heating a surface of the first or second pressing unit coming into contact with the first cleaning unit to a temperature higher than a temperature during fixing; and then to perform a cleaning operation that includes causing a cleaning material to pass through the nip portion.

10 Claims, 15 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2019-094796 filed May 20, 2019.

BACKGROUND

(i) Technical Field

The present disclosure relates to a fixing device and an image forming apparatus.

(ii) Related Art

In the related art, a fixing device includes a cleaning section that performs cleaning of an adhering material such as a toner, which adheres to at least one of a heating section and a pressing section. In the fixing device, if the amount of the adhering material such as collected toner obtained by cleaning of the cleaning section exceeds an allowable holding amount, the collected toner and the like are transferred again from the cleaning section onto the heating section or the pressing section, and thus print stains are generated. Thus, as a technique related to such a technical problem, techniques disclosed in JP-A-2003-057985, JP-A-2011-232689, and JP-A-2011-232690 have already been proposed.

In JP-A-2003-057985, a predetermined number of transfer targets are caused to pass through a fixing nip portion, and then idling of a rotating body is performed at a temperature at which image formation is performed. A cleaning member is automatically caused to pass through the fixing nip portion, and thus a toner adhering to a cleaning rotating body is collected.

In JP-A-2011-232689, if a cleaning mode is set, plural types of cleaning operations are performed in a period in which one cleaning sheet passes through the nip portion.

In JP-A-2011-232690, a cleaning mode as follows is provided. In the cleaning mode, when a surface temperature of a fixing rotating body and a surface temperature of a pressing member, which are obtained based on a detected temperature of a temperature detection member are respectively set as Th and Tp, and a deformation end point and an outflow start point of a toner of an unfixed toner image, which are measured with a flow tester are respectively set as Tf2 and Tf3, the fixing rotating body is rotated for a predetermined period in a state of Th≤Tf3 and Tf2≤Tp≤Tf3. After the fixing rotating body is rotated for the predetermined period, a recording material is nipped at the nip portion and transported. In this manner, stains of the pressing member are removed.

SUMMARY

Aspects of non-limiting embodiments of the present disclosure relate to improving the ability to remove collected toner from a cleaning unit as compared to a case where the temperature during idle cleaning is equal to or lower than the temperature during image fixing.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a first pressing unit that rotates; a second pressing unit that comes into press-contact with the first pressing unit to form a nip portion at which a toner image is fixed on a recording medium; a heating unit that heats at least one of the first and second pressing units; and a first cleaning unit that comes into contact with a surface of at least one of the first and second pressing units to perform cleaning, the fixing device being configured to perform a high-temperature rotating operation that includes rotating the first or second pressing unit and heating a surface of the first or second pressing unit coming into contact with the first cleaning unit to a temperature higher than a temperature during fixing; and then to perform a cleaning operation that includes causing a cleaning material to pass through the nip portion.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present disclosure will be described with reference to the drawings.

First Exemplary Embodiment

Figure 1:
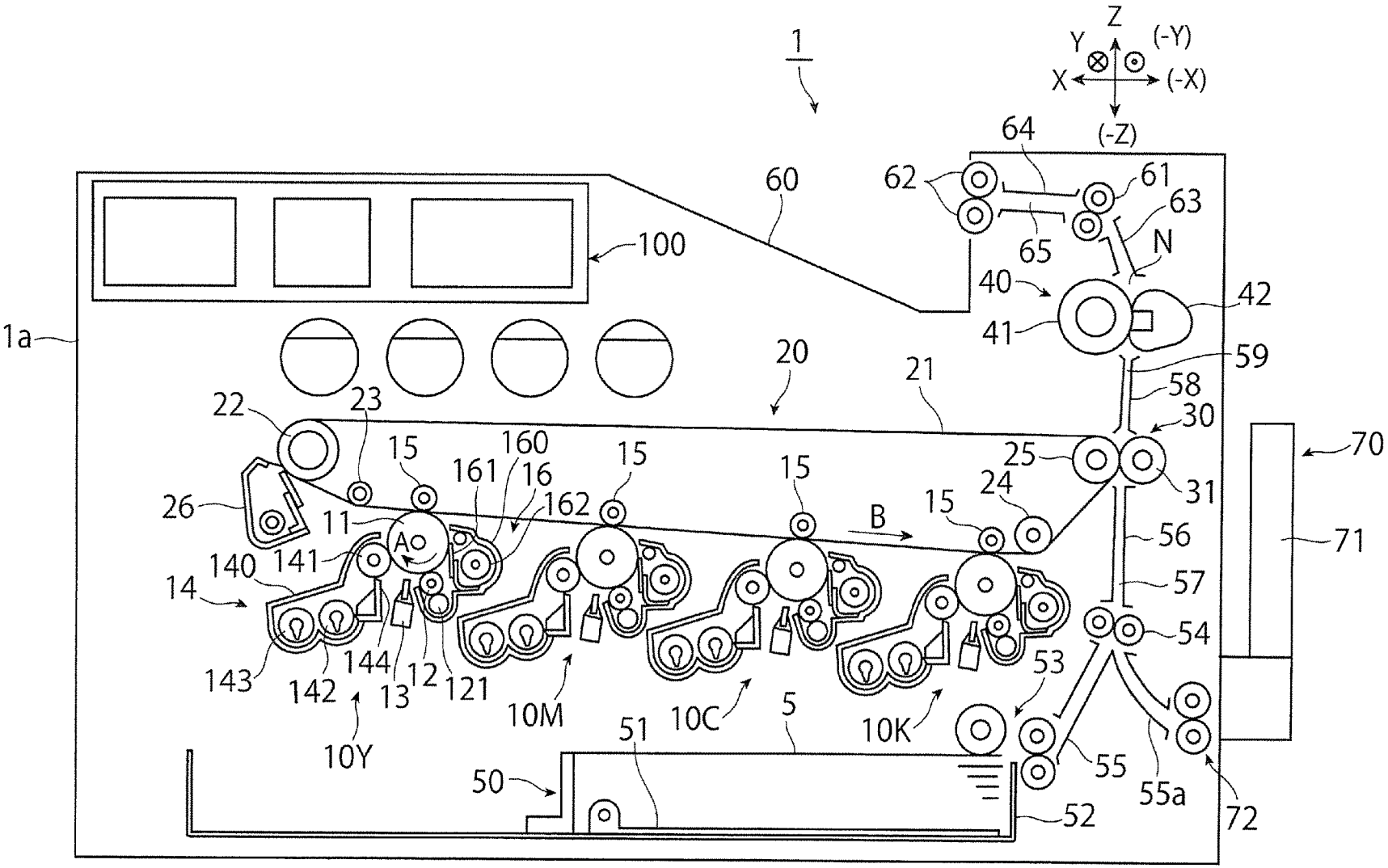
FIG. 1 is a schematic configuration diagram illustrating an image forming apparatus to which a fixing device according to a first exemplary embodiment of the present disclosure is applied.

FIG. 1 illustrates an outline of the entirety of an image forming apparatus to which a fixing device according to a first exemplary embodiment is applied. In the drawings, an arrow X indicates a width direction along a horizontal direction, an arrow Y indicates a depth direction along the horizontal direction, and an arrow Z indicates a vertical direction.

Overall Configuration of Image Forming Apparatus

An image forming apparatus 1 is configured as a color printer, for example. As illustrated in FIG. 1, the image forming apparatus 1 includes plural image forming devices 10, an intermediate transfer device 20, a paper feeding device 50, a fixing device 40 according to the exemplary embodiment, and the like. The plural image forming devices 10 form a toner image developed with a toner constituting a developer. The intermediate transfer device 20 holds a toner image formed by each of the image forming devices 10 and finally transports the toner image to a secondary transfer position for secondarily transferring the toner image onto recording paper 5 as an example of a recording medium. The paper feeding device 50 accommodates and transports required recording paper 5 to be supplied to the secondary transfer position of the intermediate transfer device 20. The fixing device 40 fixes the toner image on the recording paper 5, which has been secondarily transferred by the intermediate transfer device 20. The reference sign 1*a* indicates an apparatus main body including a support structure member, an exterior cover, and the like.

In the first exemplary embodiment, the plural image forming devices 10 and the intermediate transfer device 20 constitute an image forming unit that forms a toner image on a recording medium. The image forming unit may include a single image forming device and may be configured to directly form a toner image on a recording medium with the image forming device without passing through the intermediate transfer device.

The image forming devices 10 include four image forming devices 10Y, 10M, 10C, and 10K that exclusively form four toner images having four colors being yellow (Y), magenta (M), cyan (C), and black (K), respectively. The four image forming devices 10 (Y, M, C, K) are arranged in one row in an inclined state from the horizontal direction X in an internal space of the apparatus body 1*a*.

As illustrated in FIG. 1, each of the image forming devices 10 (Y, M, C, K) includes a photosensitive drum 11 as an example of a rotating image holding section. Devices as follows are arranged around the photosensitive drum 11. The basic devices include a charging device 12, an exposure device 13 as an example of an electrostatic latent image forming section, a developing device 14 (Y, M, C, and K) as an example of a developing section, a primary transfer device 15 as an example of a primary transfer section, and a drum cleaning device 16 as an example of a cleaning section. The charging device 12 charges a circumferential surface (image holding surface) of the photosensitive drum 11, on which image formation is possible, to a required potential. The exposure device 13 forms an electrostatic latent image (for each color) having a potential difference by irradiating the charged circumferential surface of the photosensitive drum 11 with light based on image information (signal). The developing device 14 (Y, M, C, and K) develops the electrostatic latent image with a toner of a developer having the corresponding color (Y, M, C, and K), so as to form a toner image. The primary transfer device 15 transfers each toner image to the intermediate transfer device 20. The drum cleaning device 16 performs cleaning by removing an adhering material such as the toner, which remains on and adheres to the image holding surface of the photosensitive drum 11 after the primary transfer. The reference signs indicating the photosensitive drum 11, the charging device 12, and the like are attached only to the image forming device 10Y of the yellow (Y) color, and will be omitted for the other image forming devices 10 (M, C, and K).

In the photosensitive drum 11, an image holding surface having a photoconductive layer (photosensitive layer) made of a photosensitive material on a circumferential surface of a cylindrical or columnar base material to be grounded is formed. The photosensitive drum 11 is supported such that a driving force is transferred from a driving device (not illustrated) and thus the photosensitive drum rotates in a direction indicated by an arrow A.

The charging device 12 includes a contact type charging roll disposed to come into contact with the photosensitive drum 11. A charging voltage is supplied to the charging device 12. In a case where the developing device 14 performs reversal developing, a voltage or a current having the same polarity as the charged polarity of the toner supplied from the developing device 14 is supplied as the charging voltage. A cleaning roll 121 that performs cleans on the surface of the charging device 12 is disposed on the back surface side of the charging device 12 in a state of being in contact with the charging device.

The exposure device 13 includes an LED print head and the like that forms an electrostatic latent image in a manner that the photosensitive drum 11 is irradiated with light according to image information by light emitting diodes (LEDs) as plural light emitting elements arranged along a shaft direction of the photosensitive drum 11. When a latent image is formed, information (signal) of an image input to the image forming apparatus 1 with any section is transmitted to the exposure device 13. A device that forms an electrostatic latent image by irradiating the charged circumferential surface of the photosensitive drum 11 with a laser beam configured in accordance with information of an image input to the image forming apparatus 1 may be used as the exposure device 13.

As illustrated in FIG. 1, any of the developing device 14 (Y, M, C, and K) is configured to arrange a developing roll 141, agitation transporting members 142 and 143 such as a screw auger, a layer thickness regulating member 144, and the like in a housing 140 in which an opening portion and a collection room of the developer are formed. The developing roll 141 holds a developer and transports the developer to a developing region facing the photosensitive drum 11. The agitation transporting members 142 and 143 transport the developer to pass by the developing roll 141 while agitating the developer. The layer thickness regulating member 144 regulates the amount (layer thickness) of the developer held by the developing roll 141. A developing voltage is supplied between the developing roll 141 and the photosensitive drum 11 in the developing device 14, from a power source device (not illustrated). A driving force from the driving device (not illustrated) is transmitted to the developing roll 141 or the agitation transporting members 142 and 143, and thus the developing roll 141 or the agitation transporting members 142 and 143 rotate in a required direction. A two-component developer containing a non-magnetic toner and a magnetic carrier is used as the four color developers (Y, M, C, and K).

Figure 2:
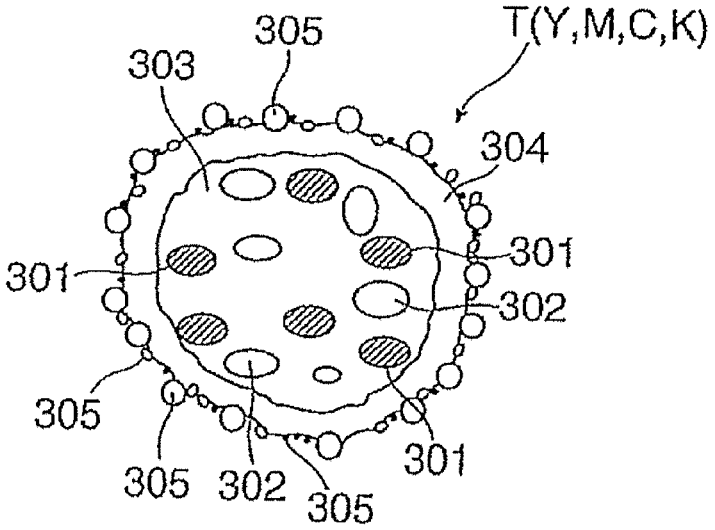
FIG. 2 is a schematic diagram illustrating a toner.

For example, an emulsion aggregation (EA) toner is used as the toner T (Y, M, C, and K) having the colors of yellow (Y), magenta (M), cyan (C), and black (K). As illustrated in FIG. 2, the emulsion aggregation toner is obtained in a manner that a particulate color material 301, a synthetic resin 302 having a low melting point, a general hot melt resin 303 in which a lubricant, and the like are dispersed are provided, and an outer circumference is coated with a general hot melt resin 304, and an external additive 305 formed with functional fine particles for adjusting electrostatic property, cleanability, or the like is added to the outer circumferential surface. For example, a polyester resin is used as the synthetic resin 302 having a low melting point or the general hot melt resins 303 and 304. The EA toner T has a number average particle diameter of about 3 to 5 μm and is formed in a substantially spherical shape. As the lubricant, for example, a fatty acid metal salt being a compound of a fatty acid such as stearic acid, lauric acid, ricinoleic acid or octylic acid and metal such as lithium, magnesium, calcium, barium or zinc is used.

As illustrated in FIG. 1, the primary transfer device 15 is a contact type transfer device that comes into contact with the circumferential surface of the photosensitive drum 11 at a primary transfer position through an intermediate transfer belt 21 and rotates, and includes a primary transfer roll to which a primary transfer voltage is supplied. As the primary transfer voltage, a DC voltage showing a polarity opposite to the charged polarity of the toner is supplied from the power source device (not illustrated).

The drum cleaning device 16 includes a cleaning blade 161, a feeding member 162 such as a screw auger, and the like. The cleaning blade 161 is disposed in a container-like main body 160 and performs cleaning by removing an adhering material such as a residual toner. The feeding member 162 collects the adhering material such as the toner, which has been removed by the cleaning blade 161 and feeds the adhering material to a collection system (not illustrated).

The intermediate transfer device 20 is disposed to be provided at a position above each of the image forming devices 10 (Y, M, C, and K). The intermediate transfer device 20 basically includes an intermediate transfer belt 21 as an example of an intermediate transfer section, plural belt support rolls 22 to 25, a secondary transfer device 30, and a belt cleaning device 26. The intermediate transfer belt 21 circulates in a direction indicated by an arrow B while passing through the primary transfer position between the photosensitive drum 11 and the primary transfer device 15 (primary transfer roll). The plural belt support rolls 22 to 25 hold the intermediate transfer belt 21 from the inner circumference to be in a desired state and support the intermediate transfer belt to be allowed to be circulated. The secondary transfer device 30 is disposed on the outer circumferential surface (image holding surface) side of the intermediate transfer belt 21 supported by the belt support roll 25 and secondarily transfers the toner image on the intermediate transfer belt 21 onto a recording paper 5. The belt cleaning device 26 performs cleaning by removing an adhering material such as the toner or paper dust, which remains on and adheres to the outer circumferential surface of the intermediate transfer belt 21 after passing through the secondary transfer device 30.

As the intermediate transfer belt 21, for example, an endless belt produced with a material in which a resistance adjusting agent such as carbon black is dispersed in a synthetic resin such as a polyimide resin, a polyamide resin, or a polyamideimide resin is used. The belt support roll 22 is configured in a form of a driving roll. The belt support roll 23 is configured in a form of a chamfering roll that holds a traveling position of the intermediate transfer belt 21. The belt support roll 24 is configured in a form of a tension applying roll. The belt support roll 25 is configured in a form of a secondary transfer backup roll.

The secondary transfer device 30 includes a secondary transfer roll 31 that rotates at a secondary transfer position corresponding to the outer circumferential surface portion of the intermediate transfer belt 21 supported by the belt support roll 25 in the intermediate transfer device 20. A DC voltage showing a polarity which is opposite to or identical to the charged polarity of the toner is supplied to the secondary transfer roll 31 or the belt support roll 25 of the intermediate transfer device 20, as a secondary transfer voltage.

The fixing device 40 is configured in a manner that a heating roll 41 as an example of a first pressing unit, a press belt 42 as an example of a second pressing unit, and the like are arranged. The heating roll 41 is heated by a heating section such that the surface temperature is held to a predetermined temperature. The press belt 42 comes into contact with the heating roll 41 at required pressure and rotates. In the fixing device 40, a contact portion at which the heating roll 41 is brought into contact with the press belt 42 corresponds to a fixing nip portion N in which a required fixing process (heating and pressing) of fixing an unfixed toner image on the recording paper 5 is performed. The fixing device 40 will be described later in detail.

The paper feeding device 50 is disposed to be provided at a position below each of the image forming devices 10 (Y, M, C, and K). The paper feeding device 50 basically includes a single paper accommodation body or bodies 52 and a feeding device 53. In the paper accommodation body 52, recording paper 5 having a desired size, a desired type, and the like is accommodated in a state of being loaded on a loading board 51. The feeding device 53 feeds the recording paper 5 from the paper accommodation body 52 one by one. For example, the paper accommodation body 52 is attached to be capable of being drawn to the front (surface on a side facing a user when the user operates) of the apparatus main body 1*a*.

The image forming apparatus 1 includes a manual paper feeding device 70 that manually feeds the recording paper 5 to one side surface (right side surface in the example illustrated in FIG. 1) of the apparatus main body 1*a*. The manual paper feeding device 70 includes a manual feed tray 71, a feeding device 72, and the like. The manual feed tray 71 is mounted in the apparatus main body 1*a* to be openable and accommodates desired recording paper 5 in a state of being loaded thereon. The feeding device 72 feeds the recording paper 5 from the manual feed tray 71 one by one. The manual paper feeding device 70 is used, for example, when recording paper 5 as an example of a cleaning material as will be described later is fed in addition to the recording paper 5 desired to form an image.

Examples of the recording paper 5 include thin paper such as plain paper or tracing paper, which is used for an electrophotographic copier, a printer, and the like, and an OHP sheet formed with a transparent film-like medium made of a synthetic resin (PET and the like). In order to improve smoothness on the surface of an image after fixing, it is preferable that the surface of the recording paper 5 is as smooth as possible. For example, coated paper in which the surface of plain paper is coated with a resin or the like, so-called thick paper such as art paper for printing, which has a relatively large basis weight, and the like can be suitably used. As the recording paper 5, embossed paper and the like in which unevenness is formed on a surface are used.

A single (or plural) paper transport roll pair 54 and a paper feeding transporting path 57 are provided between the paper feeding device 50 and the secondary transfer device 30. The paper transport roll pair 54 transports the recording paper 5 fed from the paper feeding device 50 to the secondary transfer position. The paper feeding transporting path 57 includes transporting guide materials 55 and 56. A transporting guide material 55*a* is provided between the manual paper feeding device 70 and the paper transport roll pair 54. The paper transport roll pair 54 disposed at a position just before the secondary transfer position in the paper feeding transporting path 57 is configured as a roll (registration roll) for adjusting a transporting timing of the recording paper 5, for example.

A paper transporting path 59 is provided between the secondary transfer device 30 and the fixing device 40. The paper transporting path 59 includes, for example, a transporting guide member 58 that transports the recording paper 5 fed from the secondary transfer device 30 to the fixing device 40.

An output transporting path 65 is provided on a downstream side of the fixing device 40. The output transporting path 65 includes, for example, a paper transport roll pair 61 and a paper output roll pair 62, or transporting guide materials 63 and 64, which are used for outputting the recording paper 5 on which the toner image is fixed by the fixing device 40, to a paper output unit 60 disposed at the upper portion of the apparatus main body 1*a*.

In FIG. 1, the reference sign 100 indicates a control device as an example of a control section. The control device totally controls an operation of the image forming apparatus 1. The control device 100 includes a central processing unit (CPU), a read only memory (ROM), a random access memory (RAM), a bus connecting the CPU, the ROM, and the like to each other, a communication interface, and the like, which are not illustrated in FIG. 1.

Basic Operation of Image Forming Apparatus

A basic image forming operation by the image forming apparatus 1 will be described.

Here, an image forming operation when a full-color image constituted by combining toner images having four colors (Y, M, C, and K) is formed by using the four image forming devices 10 (Y, M, C, and K) will be described. An image forming operation when an image obtained by combining a single color toner image or a toner image having plural colors is formed by using any one or more of the four image forming devices 10 (Y, M, C, and K) is basically similar.

If the image forming apparatus 1 receives command information of a printing request, the image forming apparatus 1 initiates the four image forming devices 10 (Y, M, C, and K), the intermediate transfer device 20, the secondary transfer device 30, the fixing device 40, and the like under control of the control device 100.

In each of the image forming devices 10 (Y, M, C, and K), firstly, the photosensitive drum 11 rotates in the direction indicated by the arrow A, and the charging device 12 charges the surface of the photosensitive drum 11 to have a required polarity (negative polarity in the first exemplary embodiment) and a potential. The exposure device 13 irradiates the charged surface of the photosensitive drum 11 with light emitted based on a signal of an image obtained by converting information of an image input to the image forming apparatus 1 into color components (Y, M, C, and K). Thereby, an electrostatic latent image having each color component is formed on the surface of the photosensitive drum by a required potential difference.

Each of the developing devices 14 (Y, M, C, and K) supplies a toner which has been charged to a required polarity (negative polarity) and has the corresponding color (Y, M, C, or K), to the electrostatic latent image which has been formed on the photosensitive drum 11 and has each color component. Thus, developing is performed by the toner electrostatically adhering to the electrostatic latent image. By the development, the electrostatic latent images which have been formed on the photosensitive drum 11 and have color components are visualized as toner images of four colors (Y, M, C, K) respectively developed with the corresponding color toners.

If the color toner image formed on the photosensitive drum 11 in each of the image forming devices 10 (Y, M, C, and K) is transported to the primary transfer position, the primary transfer device 15 performs primary transfer in such a manner that the toner images of the respective colors are sequentially superimposed on the intermediate transfer belt 21 of the intermediate transfer device 20, which rotates in the direction indicated by the arrow B.

In each of the image forming devices 10 (Y, M, C, and K) in which the primary transfer ends, the drum cleaning device 16 performs cleaning on the surface of the photosensitive drum 11 by removing the adhering material to scrape off the adhering material. Thus, each of the image forming devices 10 (Y, M, C, and K) becomes in a state where the next image formation operation is possible.

The intermediate transfer device 20 holds the toner image which has been primarily transferred by rotating the intermediate transfer belt 21 and transports the toner image to the secondary transfer position. The paper feeding device 50 feeds required recording paper 5 to the paper feeding transporting path 57 in accordance with the image formation operation. In the paper feeding transporting path 57, the paper transport roll pair 54 as the registration roll feeds and supplies the recording paper 5 to the secondary transfer position in accordance with a transfer timing.

The secondary transfer roll 31 collectively transfers the toner image on the intermediate transfer belt 21 onto the recording paper 5 at the secondary transfer position. In the intermediate transfer device 20 after the end of the secondary transfer, cleaning is performed in a manner that the belt cleaning device 26 removes the adhering material such as the toner, which remains on the surface of the intermediate transfer belt 21 after the secondary transfer.

The recording paper 5 on which the toner image has been secondarily transferred is peeled from the intermediate transfer belt 21 and the secondary transfer roll 31 and then is transported to the fixing device 40 along the paper transporting path 59. In the fixing device 40, the recording paper 5 which holds an unfixed toner image after the secondary transfer enters into the fixing nip portion N between the heating roll 41 and the press belt 42 which rotate, and the recording paper 5 is caused to pass through the fixing nip portion N. Thus, the necessary fixing process (heating and pressing) is performed to fix the unfixed toner image onto the recording paper 5. The recording paper 5 after the fixing ends is output to the paper output unit 60 provided at the upper portion of the apparatus main body 1*a* by the paper output roll pair 62 through the output transporting path 65.

With the above operation, a full-color image formed by combining toner images formed with toners T of four colors (Y, M, C, and K) is output.

Configuration of Fixing Device

Figure 3:
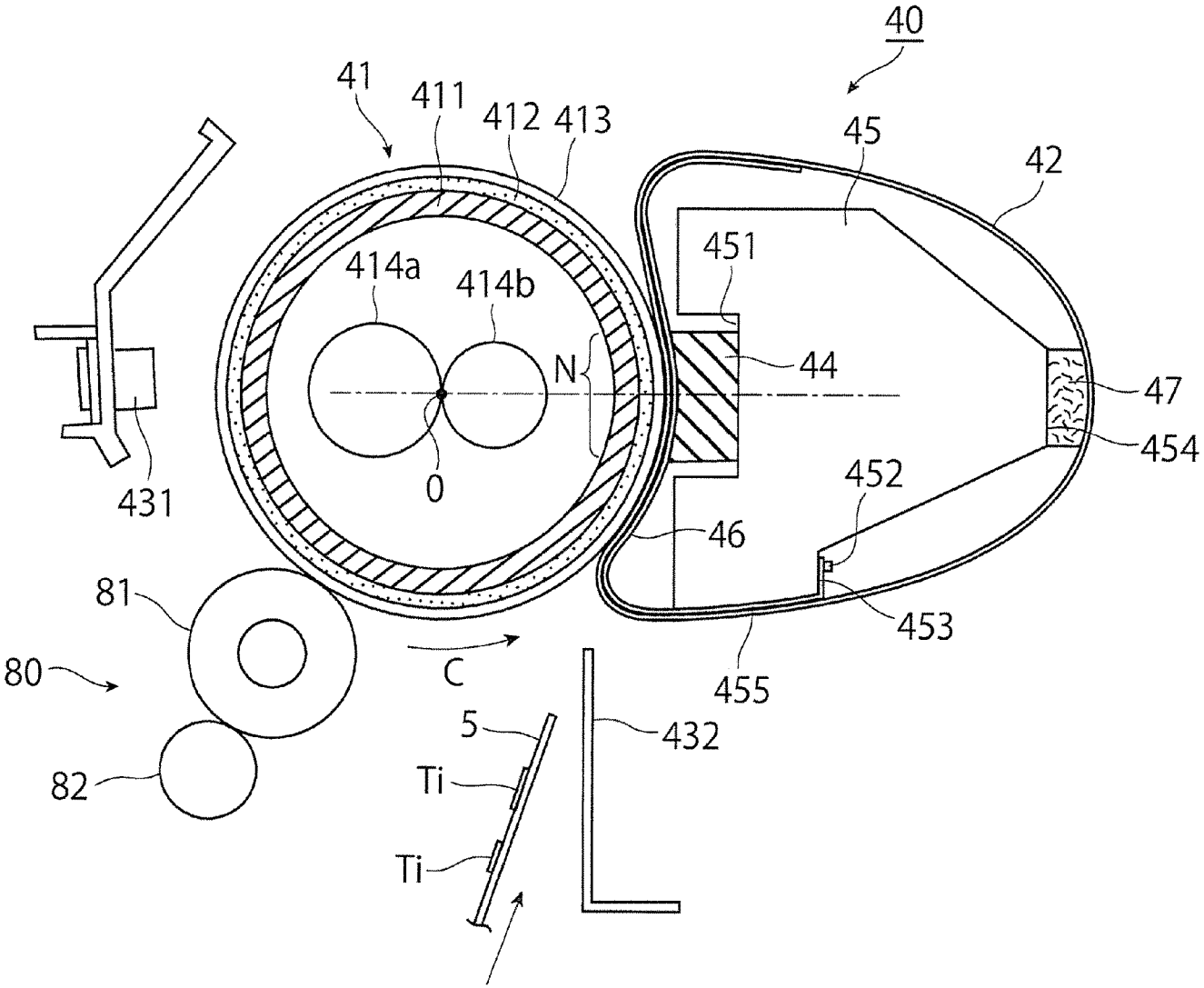
FIG. 3 is a sectional configuration diagram illustrating the fixing device according to the first exemplary embodiment of the present disclosure.

The fixing device 40 according to the first exemplary embodiment is a so-called free belt nip type fixing device. As illustrated in FIG. 3, roughly, the fixing device 40 includes a heating roll 41 as an example of the first pressing unit, a press belt 42 as an example of the second pressing unit, a press-contact member 44 as an example of a press-contact unit, a holding member 45 as an example of a holding unit, a sliding sheet 46 as an example of a sheet unit, and a felt member 47 as an example of a lubricant holding unit. The heating roll 41 rotates. The press belt 42 includes an endless belt and forms the fixing nip portion N which comes into press-contact with the heating roll 41 to fix an unfixed toner image Ti to the recording paper 5. The press-contact member 44 is disposed in the press belt 42 and brings the press belt 42 in press-contact with the surface of the heating roll 41. The holding member 45 holds the press-contact member 44. The sliding sheet 46 is interposed between the press belt 42 and the press-contact member 44 to reduce sliding resistance. The felt member 47 holds a lubricant applied onto the inner circumferential surface of the press belt 42.

The heating roll 41 includes a cylindrical core bar 411, an elastic body layer 412, and a release layer 413. The core bar 411 is made of metal such as stainless steel, aluminum, or iron (thin-walled high-tensile steel pipe). The elastic body layer 412 covers the outer circumference of the core bar 411 and is made of an elastic material such as silicone rubber or fluororubber, which has heat resistance. The release layer 413 thinly covers the surface of the elastic body layer 412 and is made of perfluoroalkoxyalkane (PFA), polytetrafluoroethylene (PTFE), or the like. In the first exemplary embodiment, perfluoroalkoxyalkane (PFA) is used for the release layer 413 of the heating roll 41. Two halogen lamps 414*a* and 414*b* as an example of a heating unit (heating source) are arranged in the heating roll 41. The two halogen lamps 414*a* and 414*b* are appropriately used in accordance with the size in a direction intersecting with a transporting direction of the recording paper 5, for example.

Both end portions of the heating roll 41 in the shaft direction are supported to a frame (not illustrated) of the fixing device 40 to be rotatable through a bearing member (not illustrated). The heating roll 41 is rotationally driven at a required speed in a direction indicated by an arrow C by a driving device (not illustrated) through a driving gear attached to one end portion along the shaft direction. A rotation speed of the heating roll 41, that is, a fixing speed, can be set to plural speeds such as a high speed, medium speed, and a low speed, in accordance with the basis weight and the like of the recording paper 5. In the first exemplary embodiment, only one type of fixing speed is set as the rotation speed of the heating roll 41. The press belt 42 is driven to rotate at substantially the same speed with the rotation of the heating roll 41 in a state of press-contacting with the outer circumferential surface of the heating roll 41.

The surface temperature of the heating roll 41 is detected by a non-contact type temperature sensor 431 as an example of a temperature detection section. Energization to the halogen lamps 414*a* and 414*b* is controlled by a temperature control circuit using a triac (not illustrated) based on a detection result of the temperature sensor 431, and thereby the surface of the heating roll 41 is heated to a required fixing temperature (for example, 170° C. to 190° C.).

In the first exemplary embodiment, plural (three) temperatures which are 170° C. as a fixing temperature for thin paper, 180° C. as a fixing temperature for plain paper, and 190° C. as a fixing temperature for thick paper are set as the surface temperature of the heating roll 41 in fixing. Here, the plain paper refers to paper having a basis weight of 52 g/m$^2$ to 105 g/m$^2$. The thick paper refers to paper having a basis weight which is greater than 105 g/m$^2$ and is equal to or smaller than 350 g/m$^2$. The thin paper refers to a paper having a basis weight which is smaller than 52 g/m$^2$. The classification of the thin paper, the plain paper, and the thick paper of the recording paper 5 is not limited to the above-described basis weight, and the recording paper 5 may be classified based on other basis weights.

As illustrated in FIG. 3, the press belt 42 is configured as a thin cylindrical flexible endless belt. The press belt 42 includes a base material layer, an elastic body layer with which the surface of the base material layer is coated, and a release layer with which the surface of the elastic body layer is coated. The press belt 42 may include the base material layer and the release layer with which the surface of the base material layer is directly coated. The base material layer is formed of a heat-resistant synthetic resin such as polyimide, polyamide, or polyamideimide, or of metal such as stainless steel, nickel, or copper. The elastic body layer is made of an elastic body such as silicone rubber or fluororubber having heat resistance. Similar to the heating roll 41, the release layer is formed of perfluoroalkoxyalkane (PFA), polytetrafluoroethylene (PTFE), or the like. In the first exemplary embodiment, similar to the heating roll 41, perfluoroalkoxyalkane (PFA) is used for the release layer (not illustrated) of the press belt 42. The thickness of the press belt 42 may be set to about 50 to 200 μm, for example.

The press belt 42 is supported such that both end portions of the press belt in a longitudinal direction (shaft direction) is rotatable by guide member (not illustrated).

The press-contact member 44 is disposed in the press belt 42. The press-contact member 44 includes a press pad that forms the fixing nip portion N between the heating roll 41 and the press belt 42 by bringing the press belt 42 into press-contact with the surface of the heating roll 41.

The press-contact member 44 is formed from an elastic body having heat resistance, such as silicone rubber or fluororubber, in an elongated rectangular parallelepiped shape having a rectangular cross-section. The press-contact member 44 is disposed to bring the press belt 42 into press-contact with the outer circumferential surface of the heating roll 41 along a center line passing through the center O of the heating roll 41. For example, an elongated rectangular plate material (not illustrated) made of a thin metal plate of stainless steel or the like is fixed on the back surface of the press-contact member 44 by a method such as adhesion.

The holding member 45 may be formed by using a heat-resistant and rigid synthetic resin such as polyphenylene sulfide (PPS), polyimide, polyester, or polyamide, or metal such as iron, aluminum, or stainless steel as a material.

As illustrated in FIG. 3, the holding member 45 is formed in an elongated rectangular parallelepiped shape having a substantially trapezoidal cross-section. A recess portion 451 for attaching the press-contact member 44 is provided on the surface of the holding member 45, which faces the heating roll 41.

It is not necessary that the entirety of the holding member 45 includes the same members. The holding member 45 may be formed by combining plural members, for example, a member that holds the press-contact member 44 and a member that presses the member that holds the press-contact member 44 against the outer circumferential surface of the heating roll 41.

The cross-sectional shape of the holding member 45 is not limited to a substantially trapezoidal shape and may be formed to have any cross-sectional shape that holds the press belt 42 to be rotatable (circularly move). The holding member 45 is disposed so that a portion (lower end surface) 455 comes into contact with the inner circumferential surface of the press belt 42 via the sliding sheet 46, in order to hold the press belt 42 to be rotatable.

The sliding sheet 46 includes an elongated planar rectangular sheet. As the sliding sheet 46, for example, a sheet including a base layer made of a fluororesin such as polytetrafluoroethylene (PTFE) and a structure made of a woven fabric or a knitted fabric made of aramid fibers or the like laminated on the surface of the base layer or both front and back surfaces is used. As the sliding sheet 46, a sheet including only a base layer made of a fluororesin such as polytetrafluoroethylene (PTFE) may be used. The thickness of the sliding sheet 46 may be set to about 100 to 200 μm.

The sliding sheet 46 is locked to plural convex portions 452 through plural engagement holes (not illustrated). The convex portions are provided at a step portion 453 of the holding member 45 toward the back surface side. The engagement holes are provided at the end portion of the sliding sheet 46 on an upstream side in the rotation direction of the press belt 42. The end portion of the sliding sheet 46 on a downstream side in the rotation direction of the press belt 42 passes through the fixing nip portion N and extends to a position along the upper end portion of the holding member 45.

As illustrated in FIG. 3, a mounting portion 454 is provided at the end portion of the holding member 45 on an opposite side of the fixing nip portion N. The mounting portion 454 is formed from a flat surface for attaching the felt member 47. The felt member 47 is attached to the mounting portion 454 by a method such as sticking with a heat-resistant double-sided tape (not illustrated) or bonding with an adhesive. A required amount (for example, about 3 g) of a lubricant to be supplied in a state of being applied onto the inner circumferential surface of the press belt 42 is impregnated in the felt member 47 in advance. As the lubricant, amino-modified silicone oil or the like having a viscosity of 100 to 350 cs is used. Since the lubricant is impregnated in the felt member 47 in advance, the lubricant is supplied to be applied onto the inner circumferential surface of the press belt 42. However, it is not limited thereto, and the lubricant may be supplied in a state of being initially applied onto the inner circumferential surface of the press belt 42.

A cleaning device 80 that removes the toner, paper dust of the recording paper 5, which adhere to the surface of the heating roll 41, and the like is disposed on the surface of the heating roll 41. The cleaning device 80 includes a cleaning roll 81 as an example of a first cleaning unit and a collecting roll 82 as an example of a second cleaning unit. The cleaning roll 81 comes into contact with the surface of the heating roll 41 at required pressing force. The collecting roll 82 comes into contact with the surface of the cleaning roll 81 at required pressing force. The cleaning roll 81 is disposed in the vicinity of the lower end portion in the figure, which is close to the fixing nip portion N, on the outer circumferential surface of the heating roll 41. The position of the cleaning roll 81 is not limited to the lower end portion close to the fixing nip portion N, and may be disposed at another position on the outer circumferential surface of the heating roll 41.

Figure 4:
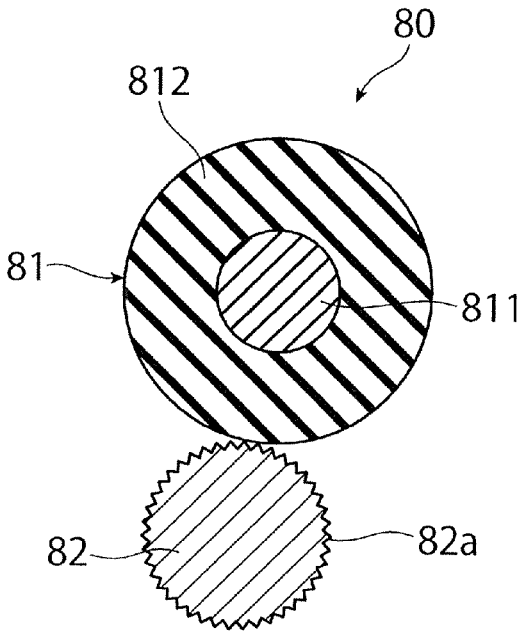
FIG. 4 is a sectional configuration diagram illustrating a cleaning device.

As illustrated in FIG. 4, the cleaning roll 81 is configured in a manner that an outer circumference of a metal core bar 811 which has a cylindrical shape and is made of stainless steel, iron, aluminum or the like is coated with a coating layer 812 made of a rubber material made of silicone rubber, fluororubber, or the like, to have a required thickness. In the first exemplary embodiment, silicone rubber is used for the coating layer 812 of the cleaning roll 81.

The collecting roll 82 is formed of metal such as stainless steel, iron, or aluminum, a synthetic resin such as a phenol resin, and the like and is formed in a solid cylindrical shape. In order to improve the ability to collect and hold the toner, the outer circumferential surface 82*a* of the collecting roll 82 is subjected to a roughening process by blasting or the like, so as to have a predetermined surface roughness. In the first exemplary embodiment, a solid cylindrical member which is made of stainless steel and has a surface 82*a* subjected to blasting is used as the collecting roll 82. The outer diameter of the collecting roll 82 is set to be smaller than that of the cleaning roll 81. The outer diameter of the collecting roll 82 may be set to be equal to or larger than that of the cleaning roll 81.

Figure 5:
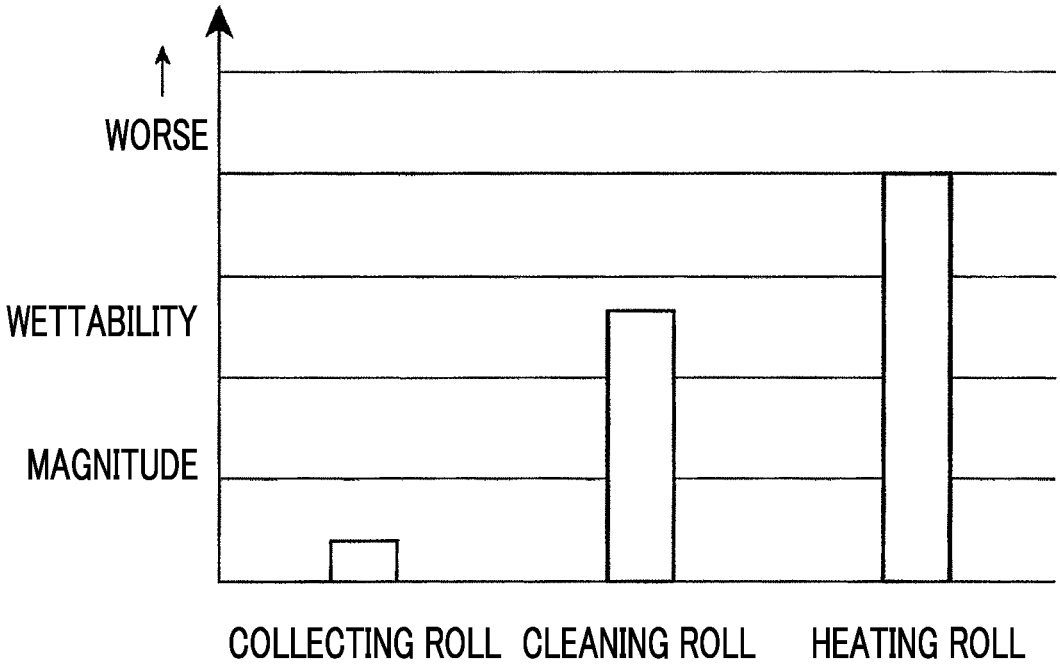
FIG. 5 is a graph illustrating an index of wettability of a heating roll, a cleaning roll, and a collecting roll.

As illustrated in FIG. 5, the heating roll 41, the cleaning roll 81, and the collecting roll 82 are set such that the wettability of the surfaces thereof decreases in order of the heating roll>the cleaning roll>the collecting roll. That is, the heating roll 41 has the worst wettability on the surface. The wettability of the surfaces of the heating roll 41, the cleaning roll 81, and the collecting roll 82 is an index indicating the magnitude of the surface free energy. As the wettability becomes better (surface free energy increases), the adhesive force to the toner increases. Thus, among the heating roll 41, the cleaning roll 81, and the collecting roll 82, the collecting roll 82 has the largest adhesive force to the toner, the cleaning roll 81 is the next largest, and the heating roll 41 has the small adhesive force to the toner. Therefore, the toner adhering to the surface of the heating roll 41 is transferred to the cleaning roll 81 having a larger adhesive force. The toner transferred to the cleaning roll 81 is finally transferred to the collecting roll 82 having the highest adhesive force, and thus is collected and accumulated.

If the wettability of the surfaces of the heating roll 41, the cleaning roll 81, and the collecting roll 82 is represented by a contact angle of water, perfluoroalkoxyalkane (PFA) forming the release layer 413 being a surface layer of the heating roll 41 has an angle of about 109 degrees. Silicone rubber forming the coating layer 812 of the cleaning roll 81 has an angle of about 80 to 90 degrees. Stainless steel forming the collecting roll 82 has an angle of about 80 degrees. If the collecting roll 82 is made of stainless steel and has a surface 82*a* subjected to blasting, the wettability is more improved (contact angle of the water is reduced). Aluminum usable as the material of the collecting roll 82 is excellent in wettability because the contact angle of the water is about 4.6 degrees, and this is very small.

As illustrated in FIG. 3, in the fixing device 40, in a fixing operation, fixing processing is performed by causing the recording paper 5 holding an unfixed toner image Ti to pass through the fixing nip portion N. At this time, the unfixed toner image Ti held by the recording paper 5 comes into contact with the surface of the heating roll 41 at the fixing nip portion N. However, in the toner forming the unfixed toner image Ti, the amount of the toner transferred (offset) to the surface of the heating roll 41 is about zero or very small even though the toner is transferred, because the toner forming the unfixed toner image Ti has the very large adhesive force to the recording paper 5.

Even if the toner is transferred to the surface of the heating roll 41, the toner transferred to the surface of the heating roll 41 moves to a cleaning position coming into contact with the cleaning roll 81 by rotation of the heating roll 41. The toner transferred to the surface of the heating roll 41 is subjected to cleaning (removed) by moving from the surface of the heating roll 41 to the cleaning roll 81 at the cleaning position. The toner moved to the surface of the cleaning roll 81 moves from the surface of the cleaning roll 81 to the collecting roll 82 at a collect position coming into contact with the collecting roll 82, and then is collected. The toner collected by the collecting roll 82 is held in a state of adhering to the outer circumferential surface of the collecting roll 82.

As described above, in the fixing device 40, in the normal fixing operation, the amount of the toner transferred to the outer circumferential surface of the heating roll 41 is about zero or very small. Therefore, even in a case where the fixing device 40 is used for a long term, the total amount of the toner removed and collected by the cleaning roll 81 and the collecting roll 82 of the cleaning device 80 is not so much. Thus, the cleaning device 80 disposed on the heating roll 41 can be used until the fixing device 40 reaches the end of the life without replacing the cleaning roll 81 and the collecting roll 82.

Figure 6A:
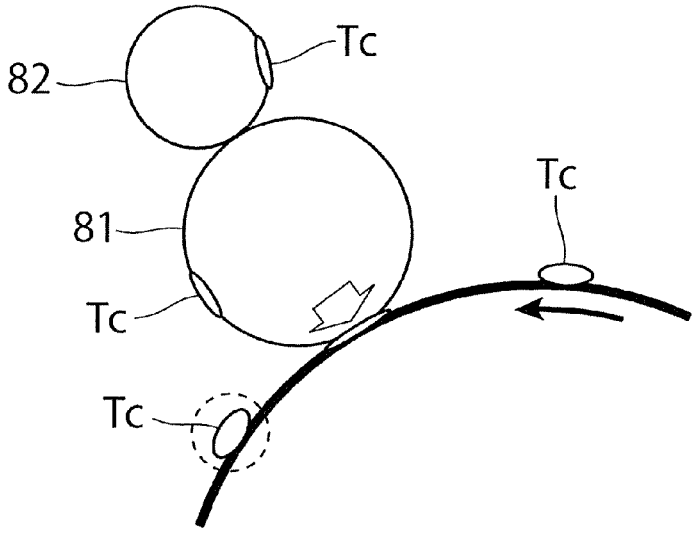
FIG. 6A ( RELATED ART )
FIGS. 6A to 6C are configuration diagrams illustrating an operation of a cleaning device in the related art.

However, in the fixing device 40, as illustrated in FIG. 6A, for example, in a case where so-called borderless printing in which a full color image or the like is formed over the outer circumferential edge of the recording paper 5 is continuously performed, the toner tends to adhere to the surface of the heating roll 41 from the outer edge of the recording paper 5. This is because, in a region other than the outer edge portion of the recording paper 5, other toner images are provided around the toner image. Thus, an attraction force acts between the adjacent toner images, and the toner of the toner image has difficulty in adhering to the surface of the heating roll 41. On the contrary, at the outer edge portion of the recording paper 5, any other toner image is not provided outside the toner image at the outer edge portion. Thus, the attraction force does not act between the adjacent toner images, and the toner of the toner image adheres to the surface of the heating roll 41 easier than in the region other than the outer edge. The toner Tc adhering to the surface of the heating roll 41 is subjected to cleaning by the cleaning roll 81, and then moves from the surface of the cleaning roll 81 to the collecting roll 82 to be collected. At this time, the toner Tc which is not subjected to cleaning at once by the cleaning roll 81 remains on the surface of the heating roll 41. Here, the borderless printing is not limited to a case where the toner image is formed over the outer circumference of the recording paper 5, and includes a case where the toner image is formed to provide a slight gap inside the outer circumference of the recording paper 5.

Figure 6B:
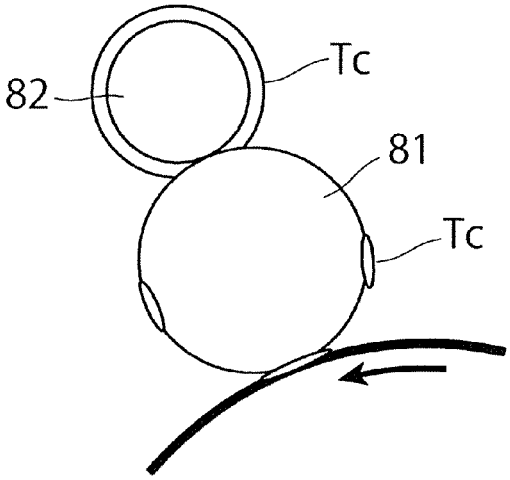
FIG. 6B ( RELATED ART )

Therefore, as illustrated in FIG. 6B, the toner Tc removed from the surface of the heating roll 41 is gradually accumulated on the surface of the collecting roll 82 through the cleaning roll 81. For example, in a case where a borderless print image is fixed on multiple sheets of the recording paper 5, that is, if the amount of the collected toner Tc accumulated on the surface of the collecting roll 82 exceeds an allowable amount which can be held by the collecting roll 82, as illustrated in FIG. 6C, part of the collected toner Tc is reversely transferred to the cleaning roll 81, and is accumulated on the outer circumferential surface of the cleaning roll 81.

Figure 6C:
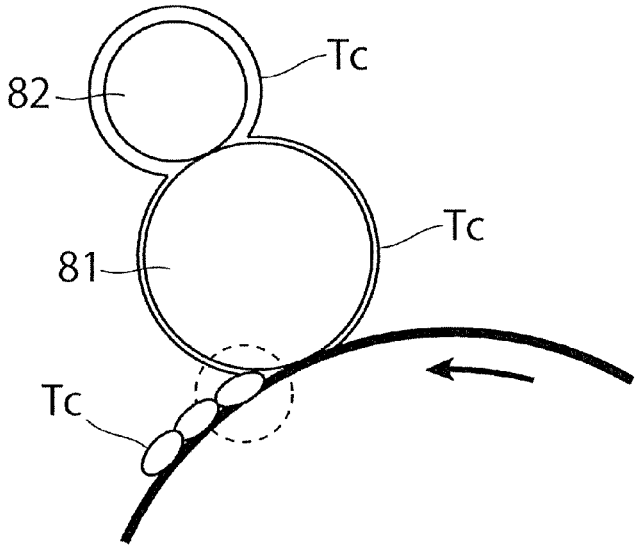
FIG. 6C ( RELATED ART )

Further, if the number of recording paper 5 on which borderless printing is performed increases cumulatively, and thus the amount of the collected toner Tc accumulated on the outer circumferential surface of the cleaning roll 81 exceeds the allowable amount, as illustrated in FIG. 6C, a portion of the collected toner Tc held on the outer circumferential surface of the cleaning roll 81 is reversely transferred to the surface of the heating roll 41.

The collected toner Tc which has been reversely transferred to the surface of the heating roll 41 is transferred onto the recording paper 5 to be subjected to fixing processing thereafter, or is transferred to the press belt 42 and then transferred to the back surface of the recording paper 5 to cause image stain. As a result, the fixing device 40 has a lifespan which does not allow the cleaning device 80 to perform a cleaning function, and thus it is necessary to replace the entirety of the fixing device 40.

In the fixing device 40, for example, so-called jam (paper jam) which is a transport failure of the recording paper 5 may occur, that is, the toner T forming the unfixed toner image Ti on the recording paper 5 may adhere to the surface of the heating roll 41 in a large amount, in addition to the borderless printing described above.

More specifically, in a case where jam of the recording paper 5 that holds the unfixed toner image Ti occurs at the fixing nip portion N of the fixing device 40, normally, a nip release mechanism (not illustrated) is operated to release the press-contact state between the heating roll 41 and the press belt 42. In this state, the recording paper 5 of which the jam occurs at the fixing nip portion N is removed. In this case, the recording paper 5 that holds the unfixed toner image Ti does not come into contact with the surface of the heating roll 41 or comes into contact with the surface of the heating roll 41 by a weak force even though the contact occurs. Thus, a situation in which a large amount of the toner T of the unfixed toner image Ti held on the recording paper 5 adheres to the surface of the heating roll 41 does not occur.

However, depending on a user, when the jam of the recording paper 5 occurs at the fixing nip portion N of the fixing device 40, the press-contact state between the heating roll 41 and the press belt 42 is not released, and the leading end of the recording paper 5 is grasped and pulled from the paper output roll pair 62 side of the apparatus main body 1*a*. Thereby, the recording paper 5 of which the jam occurs may be removed.

In this case, when the recording paper 5 is pulled out, the heating roll 41 rotates while the recording paper 5 moves. Thus, the toner T forming the unfixed toner image Ti held on the recording paper 5 adheres to the surface of the heating roll 41 in a large amount. The toner Tc adhering to the surface of the heating roll 41 in the large amount is subjected to cleaning by the cleaning roll 81 at the cleaning position and is transferred to the surface of the cleaning roll 81. The large amount of the toner transferred to the surface of the cleaning roll 81 is collected by the collecting roll 82 and is held on the surface of the collecting roll 82.

As described above, if the recording paper 5 is removed without releasing the press-contact state between the heating roll 41 and the press belt 42, the amount of the toner adhering to the surface of the heating roll 41 becomes large even once. If the amount of the collected toner Tc accumulated on the surface of the collecting roll 82 exceeds the allowable amount which can be held by the collecting roll 82, a portion of the collected toner Tc starts to be reversely transferred to and accumulated on the outer circumferential surface of the cleaning roll 81. If the amount of the collected toner Tc accumulated on the outer circumferential surface of the cleaning roll 81 exceeds the allowable amount, as illustrated in FIG. 6C, a portion of the collected toner Tc held on the outer circumferential surface of the cleaning roll 81 starts to be reversely transferred to the surface of the heating roll 41, and the fixing device 40 reaches the end of the life.

Further, in the fixing device 40, embossed paper having an unevenness on a surface may be used as the recording paper 5. The embossed paper is different from flat plain paper in that it is difficult to apply sufficient fixing pressure and heat to the unfixed toner image Ti at the recess portion of the surface when the embossed paper passes through the fixing nip portion N of the fixing device 40. Therefore, in the embossed paper, it is easy to cause the toner T forming the unfixed toner image Ti to adhere to the surface of the heating roll 41, and the amount of the toner collected by the cleaning roll 81 is much larger than that of plain paper.

As described above, in the fixing device 40, if many sheets of embossed paper are used as the recording paper 5, it may be easy to cause the toner T of the unfixed toner image Ti to adhere to the surface of the heating roll 41, and a large amount of the collected toner Tc may be collected by the cleaning roll 81. Thus, the amount of the collected toner Tc held by the cleaning roll 81 and the collecting roll 82 may exceed the allowable amount.

In any case, since a fixing device 40 in the related art does not include a section configured to remove the collected toner Tc from the cleaning roll 81 and the collecting roll 82, if the cleaning roll 81 and the collecting roll 82 reach the end of the lives, the fixing device 40 is to be replaced with a new fixing device.

In the fixing device 40 according to the first exemplary embodiment, the removability of the collected toner Tc held by the cleaning roll 81 and the collecting roll 82 is improved. Even in a case where the amount of the collected toner Tc adhering to the cleaning roll 81 and the collecting roll 82 reaches the allowable amount, it is possible to continuously use the cleaning roll 81 and the collecting roll 82 by removing the collected toner Tc adhering to the cleaning roll 81 and the collecting roll 82.

In order to clarify conditions in which the collected toner Tc adhering to the cleaning roll 81 and the collecting roll 82 can be removed, the present disclosers have considered how the force causing the collected toner Tc adhering to the cleaning roll 81 and the collecting roll 82 to aggregate each other, that is, a cohesive force which causes the collected toner Tc adhering to the cleaning roll 81 and the collecting roll 82 to maintain a state of aggregating each other and adhering to the cleaning roll 81 and the collecting roll 82 as it is, and an adhesive force with which the toner adheres to the surface of each of the heating roll 41, the cleaning roll 81, and the collecting roll 82 changes depending on the temperature.

As a result, the present disclosers have found the followings. That is, depending on the temperatures of the heating roll 41, the cleaning roll 81, and the collecting roll 82, the cohesive force causing the collected toner Tc adhering to the outer circumferential surfaces of the cleaning roll 81 and the collecting roll 82 to aggregate each other causes the adhesive force of the collected toner Tc to the outer circumferential surface of the heating roll 41 to be increase. Thus, it is possible to remove the collected toner Tc adhering to the cleaning roll 81 and the collecting roll 82 by reversely transferring the collected toner Tc to the heating roll 41 from the cleaning roll 81 and the collecting roll 82.

Figure 7:
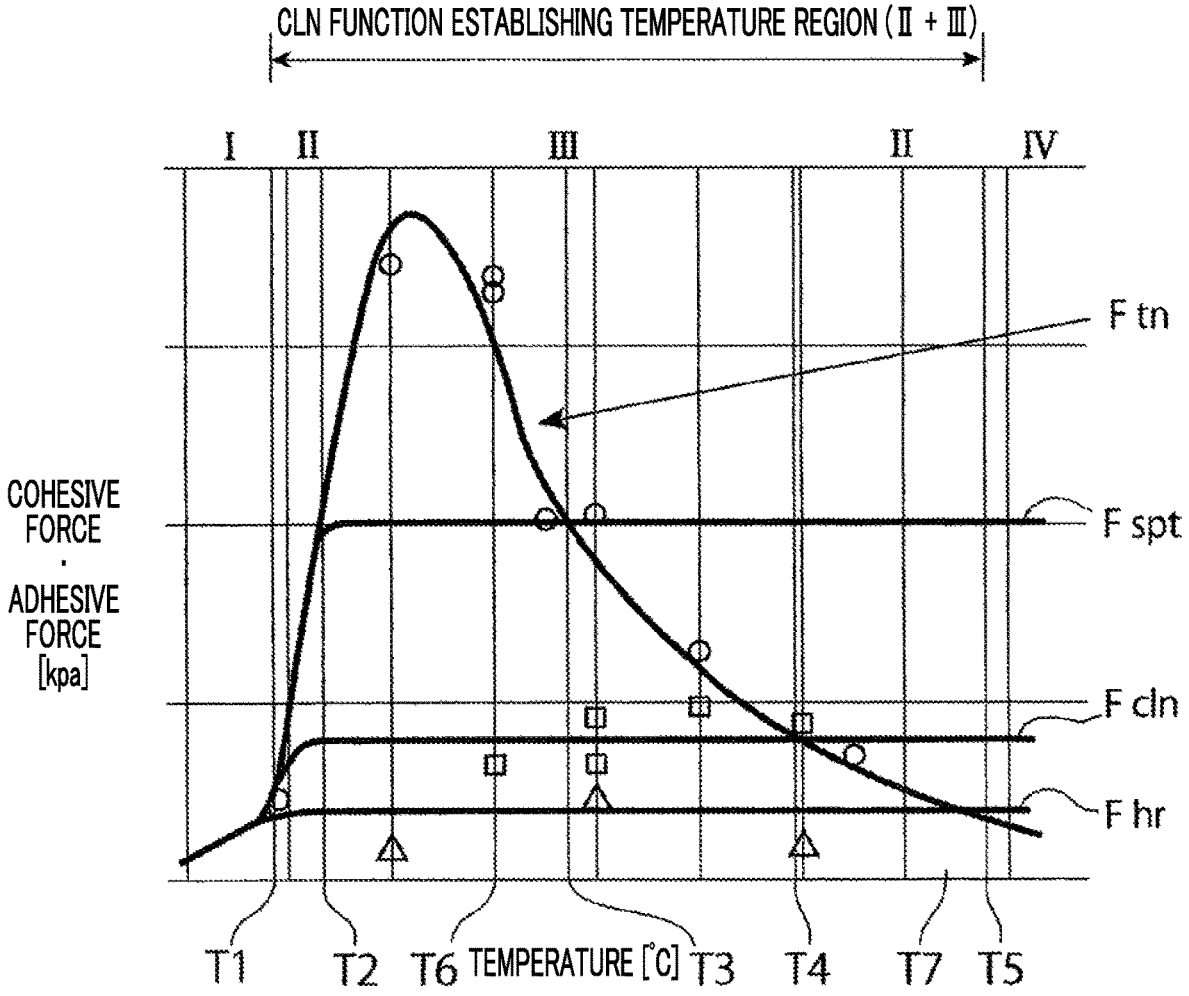
FIG. 7 is a graph illustrating a relation between a temperature, and a toner cohesive force and an adhesive force of the toner to surfaces of the heating roll, the cleaning roll, and the collecting roll.

FIG. 7 is a graph in which a horizontal axis indicates a temperature, and a vertical axis indicates a result obtained by measuring a cohesive force Ftn of the collected toner, and adhesive forces Fhr, Fcln, and Fspt of the toner to the surfaces of the heating roll 41, the cleaning roll 81, and the collecting roll 82, respectively. Regarding the collected toner and a new toner, paper dust or the like of the recording paper 5 may be mixed in the collected toner, and strictly speaking, the composition is different. However, here, the new toner was used as the collected toner. As the new toner, EA-Eco toner manufactured by Fuji Xerox Co., Ltd. was used.

The release layer 413 provided on the surface of the heating roll 41 was made of perfluoroalkoxyalkane (PFA). The coating layer 812 of the cleaning roll 81 was made of silicone rubber. The surface 82*a* of the collecting roll 82 was made of blasted stainless steel.

Figure 8:
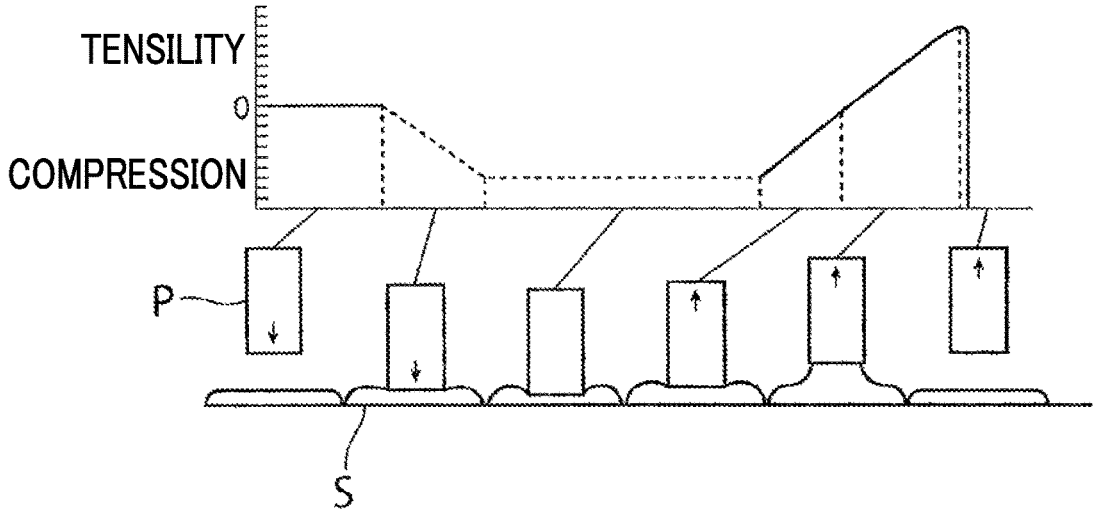
FIG. 8 is a schematic diagram illustrating a measurement principle for measuring the adhesive force of the toner.

The adhesive force of the toner to the surface of each of the heating roll 41, the cleaning roll 81, and the collecting roll 82 was measured using a tacking tester. As the tacking tester, TAC-1000 manufactured by Resuka Co., Ltd. was used. As illustrated in FIG. 8, the tacking tester is used as follows. A predetermined amount of toner being a target for measuring the adhesive force is placed on the surface of a stage S. A probe P having a lower end surface made of the same material as that of the surface of each of the heating roll 41, the cleaning roll 81, and the collecting roll 82 is caused to come into press-contact with the surface of the toner placed on the stage S. Then, the maximum value of the adhesive force (kPa) required to pull up the probe P is measured.

Figure 9:
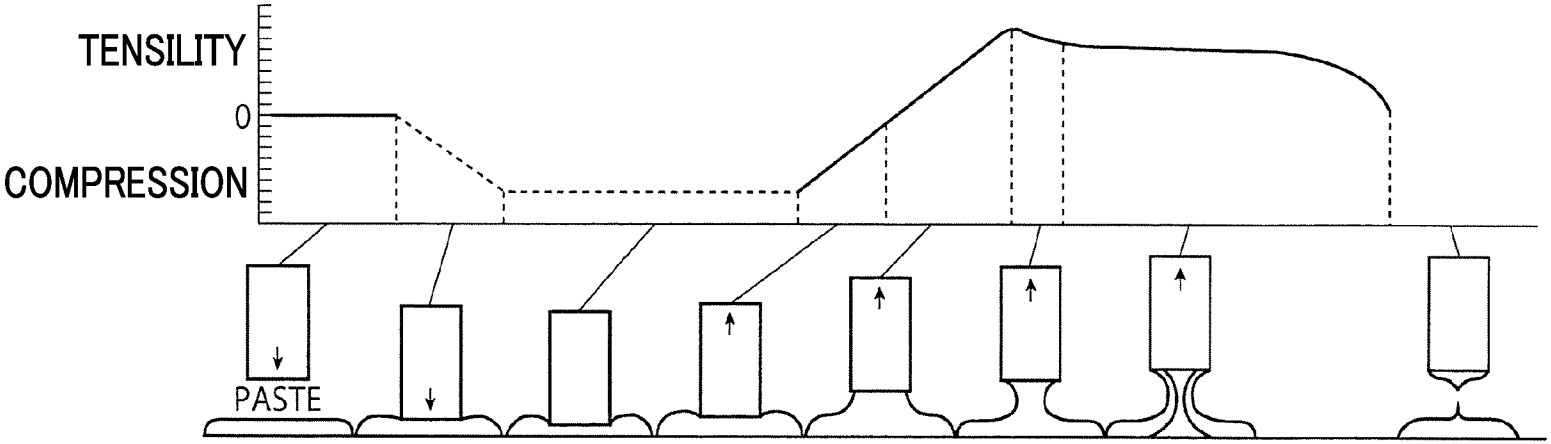
FIG. 9 is a schematic diagram illustrating the measurement principle for measuring the adhesive force of the toner.

In a case where the adhesive force of the toner to the surface of each of the heating roll 41, the cleaning roll 81, and the collecting roll 82 is larger than the cohesive force Ftn of the collected toner, as illustrated in FIG. 9, the toner is not peeled from the probe P, and the cohesive force Ftn of the aggregated toner reaches the limit. Thus, the toner is divided. Thus, if the temperature at which the state is moved from the state in FIG. 8 to the state in FIG. 9 is measured using the tacking tester, it is possible to obtain the temperature at which the adhesive force of the toner to the surface of each of the heating roll 41, the cleaning roll 81, and the collecting roll 82 is equal to the cohesive force Ftn of the collected toner in FIG. 7.

The adhesive force was measured by changing the temperatures of the probe P and the stage S over a range from room temperature to about 220° C. in a laboratory environment (temperature of 20° C., relative humidity of 50%).

The cohesive force of the collected toner was measured as follows.

The cohesive force of the toner corresponds to internal resistance when the toner flows. The cohesive force of the toner is a standard for fluidity of the toner. The cohesive force of the fluidized toner was obtained by measuring the viscosity of the toner.

Figure 10:
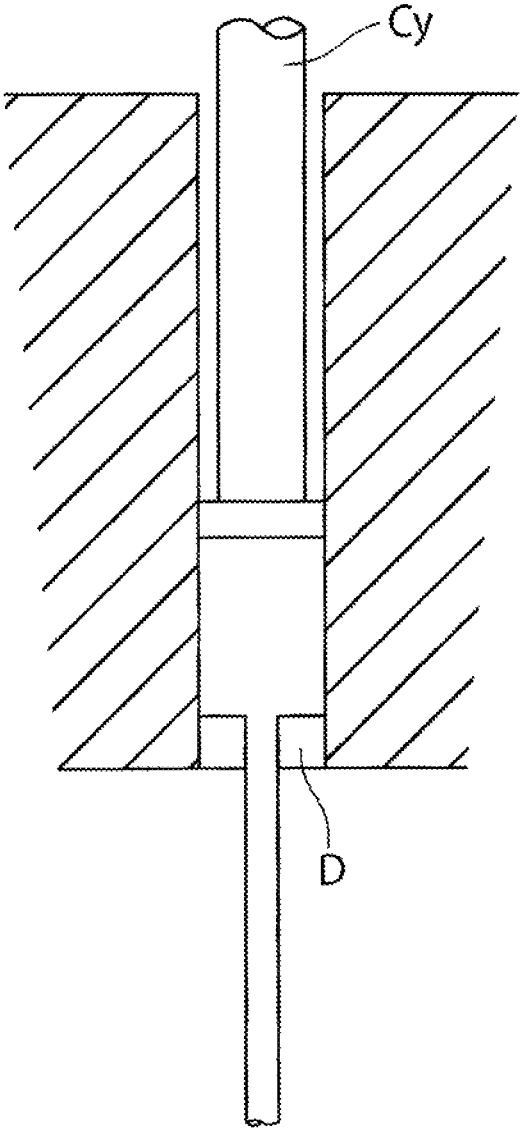
FIG. 10 is a schematic diagram illustrating a measuring device that measures viscosity of the toner.

As a measuring device for measuring the viscosity of the toner, a Koka type Flow Tester CFT-500C (manufactured by Shimadzu Corporation) was used. As illustrated in FIG. 10, the viscosity of the toner was measured in a manner as follows. Under conditions in which the diameter of pores of a die D, through which the fluidized toner passes was 0.5 mm, the length of the pore of the die D was 1.0 mm, a pressurization load of a cylinder Cy is 0.98 MPa (10 $Kg/cm^2$), a preheat time is 5 minutes, a heating rate was 1.0° C./min, a temperature measurement interval was 1.0° C., and a measurement start temperature was 65° C., 1.1 g of the toner was weighed, and the toner was set in the Koka type flow tester CFT-500C. The toner was melted out, and thereby the viscosity of the toner was measured. The melting point of a polystyrene resin mainly forming the toner is about 225 to 276° C. The unit of the viscosity of the toner is kPaS.

In order to allow the adhesive force of the toner, which was measured using the tacking tester to be compared with the viscosity of the toner, which was measured using the Koka type flow tester, as illustrated in FIG. 7, for example, as described above, the temperature at which the state is transferred from the state in FIG. 8 to the state in FIG. 9 may be measured using the tacking tester.

As is apparent from FIG. 7, the adhesive forces Fhr, Fcln, and Fspt of the collected toner Tc to the surfaces of the heating roll 41, the cleaning roll 81, and the collecting roll 82 reach a substantially predetermined value after rapidly increasing as the temperature rises from room temperature. The adhesive forces maintain the substantially predetermined values even though the temperature rises after that.

Regarding the adhesive forces Fhr, Fcln, and Fspt of the collected toner Tc to the surfaces of the heating roll 41, the cleaning roll 81, and the collecting roll 82, considering the ability to collect the toner, the collecting roll 82 is set to have the largest adhesive force, the cleaning roll 81 is set to have the next largest adhesive force, and the heating roll 41 is set to have the smallest adhesive force (Fhr<Fcln<Fspt).

As is apparent from FIG. 7, the cohesive force Ftn of the collected toner Tc increases rapidly with an increase of the temperature, similar to the adhesive forces Fhr, Fcln, and Fspt of the collected toner Tc. After the cohesive force Ftn reaches the peak at a required temperature (the vicinity of a glass transition temperature), the cohesive force Ftn decreases in inverse proportion to the temperature.

If the adhesive forces Fhr, Fcln, and Fspt of the collected toner to the surfaces of the heating roll 41, the cleaning roll 81, and the collecting roll 82 are compared with the cohesive force Ftn of the collected toner Tc, as illustrated in FIG. 7, the adhesive forces Fhr, Fcln, and Fspt and the cohesive force Ftn simultaneously increase rapidly with the increase of the temperature. Then, the adhesive force Fhr of the toner to the surface of the heating roll 41 reaches a substantially predetermined value firstly, the adhesive force Fcln of the toner to the surface of the cleaning roll 81 reaches a substantially predetermined value secondly, and the adhesive force Fspt of the toner to the surface of the collecting roll 82 reaches a substantially predetermined value thirdly. The cohesive force Ftn of the collected toner Tc reaches the peak lastly.

The cohesive force Ftn of the collected toner Tc decreases rapidly with the increase of the temperature. The cohesive force Ftn falls below the adhesive force Fspt of the toner to the surface of the collecting roll 82 firstly, falls below the adhesive force Fcln of the toner to the surface of the cleaning roll 81 secondly, and falls below the adhesive force Fhr of the toner to the surface of the heating roll 41 lastly.

Here, in FIG. 7, a temperature Ti indicates a temperature at which a curve indicating the cohesive force Ftn of the collected toner Tc intersects with (is equivalent to) a line indicating the adhesive force Fhr of the toner to the surface of the heating roll 41. A temperature T2 indicates a temperature at which the curve indicating the cohesive force Ftn of the collected toner Tc intersects with a line indicating the adhesive force Fspt of the toner to the surface of the collecting roll 82. A temperature T3 indicates a temperature at which the curve indicating the cohesive force Ftn of the collected toner Tc intersects with the line indicating the adhesive force Fspt of the toner to the surface of the collecting roll 82. A temperature T4 indicates a temperature at which the curve indicating the cohesive force Ftn of the collected toner Tc intersects with a line indicating the adhesive force Fcln of the toner to the surface of the cleaning roll 81. A temperature T5 indicates a temperature at which the curve indicating the cohesive force Ftn of the collected toner Tc intersects with the line indicating the adhesive force Fhr of the toner to the surface of the heating roll 41.

The temperature region from the temperature Ti to the temperature T5 indicates a temperature region in which the cleaning function of removing the toner Tc adhering to the surface of the heating roll 41 by the cleaning roll 81 and the collecting roll 82 is established.

For example, the fixing temperature of the fixing device 40 is appropriately set in a range from a temperature T6 located between the temperatures T2 and T3 to a temperature T7 located between the temperatures T4 and T5.

Figure 11:
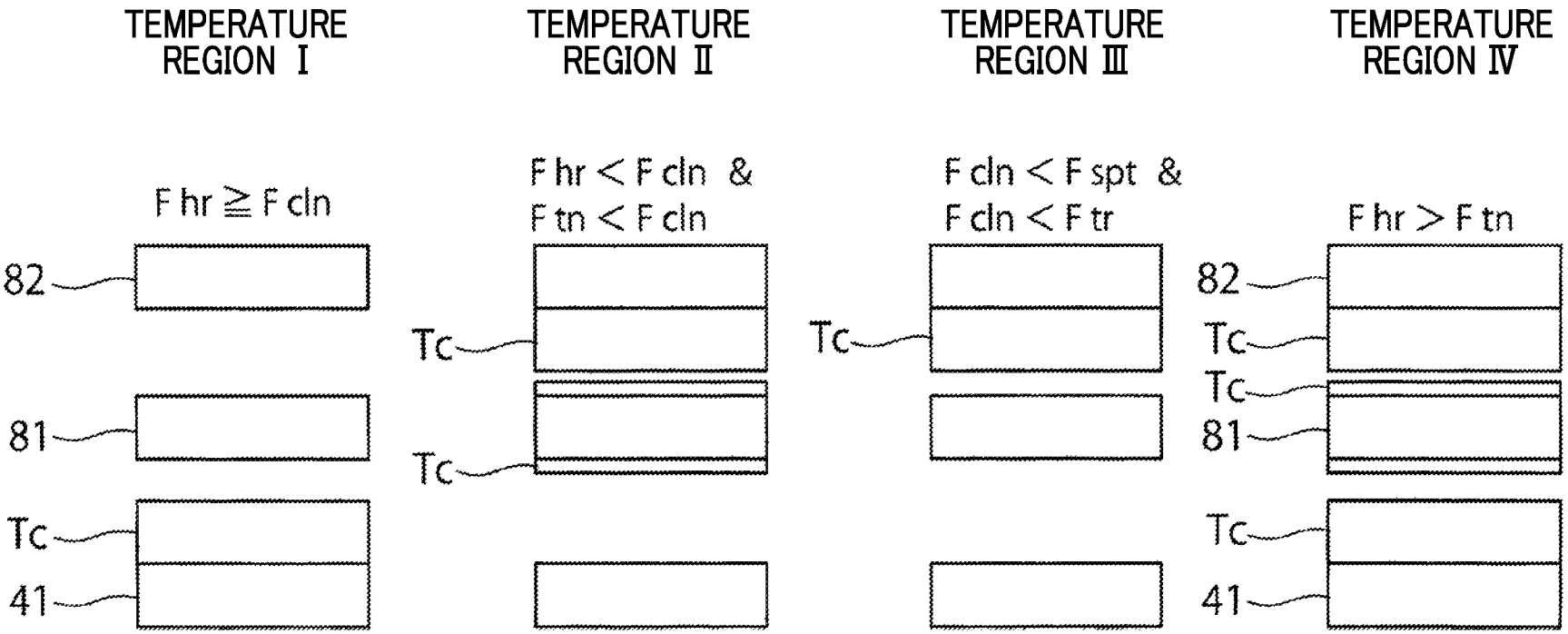
FIG. 11 is a diagram illustrating a principle for collecting toner.

In FIG. 7, in a temperature region I which is lower than the temperature T1, the adhesive force Fhr of the toner to the surface of the heating roll 41 is substantially equal to the adhesive force Fcln of the toner to the surface of the cleaning roll 81. Thus, as illustrated in FIG. 11, the toner Tc adhering to the surface of the heating roll 41 is not transferred to the surface of the cleaning roll 81, but continuously adheres to the surface of the heating roll 41 at the cleaning position. Accordingly, it is not possible to perform cleaning of the toner.

Next, in a temperature region II from the temperature Ti to the temperature T2, the adhesive force Fcln of the toner to the surface of the cleaning roll 81 is larger than the adhesive force Fhr of the toner to the surface of the heating roll 41 (Fhr<Fcln). Thus, the toner Tc adhering to the surface of the heating roll 41 is transferred to the surface of the cleaning roll 81 at the cleaning position, and thus it is possible to perform cleaning of the toner.

Similarly, in a temperature region III from the temperature T2 to the temperature T4, the adhesive force Fspt of the toner to the surface of the collecting roll 82 is larger than the adhesive force Fcln of the toner to the surface of the cleaning roll 81 (Fcln<Fspt), and the cohesive force Ftn of the collected toner is larger than the adhesive force Fcln of the toner to the surface of the cleaning roll 81. Thus, the collected toner Tc adhering to the surface of the cleaning roll 81 moves to the surface of the collecting roll 82 and continuously remains on the surface of the collecting roll 82.

Further, in a temperature region II from the temperature T4 to the temperature T5, the adhesive force Fcln of the toner to the surface of the cleaning roll 81 is larger than the adhesive force Fhr of the toner to the surface of the heating roll 41 (Fhr<Fcln), and the adhesive force Fcln of the toner to the surface of the cleaning roll 81 is larger than the cohesive force Ftn of the collected toner (Ftn<Fcln). Thus, the toner Tc adhering to the surface of the heating roll 41 is transferred to the surface of the cleaning roll 81 at the cleaning position, and thus it is possible to perform cleaning of the toner.

On the contrary, in a temperature region IV which is higher than the temperature T5, the adhesive force Fcln of the toner to the surface of the cleaning roll 81 is larger than the cohesive force Ftn of the collected toner, and the adhesive force Fhr of the toner to the surface of the heating roll 41 is larger than the cohesive force Ftn of the collected toner (Ftn<Fhr). Thus, the collected toner Tc coming into contact with the surface of the cleaning roll 81 in the collected toner Tc adhering to the surface of the collecting roll 82 is transferred to the surface of the cleaning roll 81 because the adhesive force Fcln of the toner to the surface of the cleaning roll 81 is stronger than the cohesive force Ftn of the collected toner Tc.

Similarly, in the temperature region IV which is higher than the temperature T5, the collected toner Tc coming into contact with the surface of the heating roll 41 in the collected toner Tc adhering to the surface of the cleaning roll 81 is transferred to the surface of the heating roll 41 because the adhesive force Fhr of the toner to the surface of the heating roll 41 is stronger than the cohesive force Ftn of the collected toner Tc (Ftn<Fhr).

As a result, if the temperatures of the heating roll 41, the cleaning roll 81, and the collecting roll 82 are set to the temperature region IV which is higher than the temperature T5, it is possible to transfer the collected toner Tc held by the collecting roll 82 to the surface of the cleaning roll 81, and to transfer the collected toner Tc transferred to the surface of the cleaning roll 81, to the surface of the heating roll 41. Here, the temperature in the temperature region IV which is higher than the temperature T5 is set to 210° C., for example.

In FIG. 11, for convenience, gaps for clarifying the presence of the collected toner Tc adhering to each of the rolls are formed between the heating roll 41, the cleaning roll 81, and the collecting roll 82. However, the rolls may be disposed to come into contact with each other.

Figure 12:
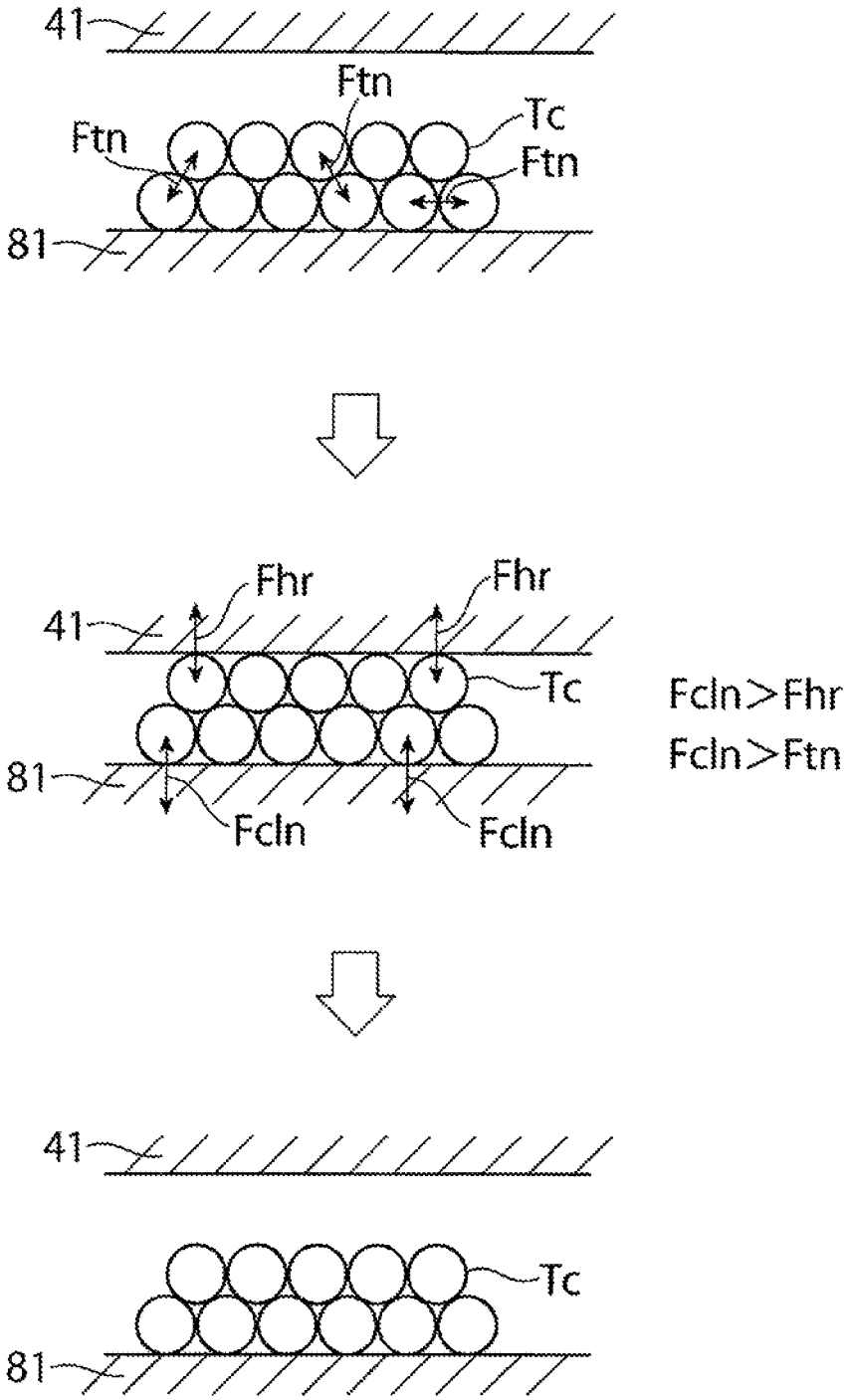
FIG. 12 is a diagram illustrating an adhesion state of the toner to the surfaces of the heating roll and the cleaning roll.

More specifically, as illustrated in FIG. 12, it is considered that the adhesive force Fcln to the surface of the cleaning roll 81, the adhesive force Fhr to the surface of the heating roll 41, and the cohesive force Ftn causing the collected toner to aggregate each other act on the collected toner Tc held on the surface of the cleaning roll 81. Here, for convenience, a case where the collected toner Tc held on the surface of the cleaning roll 81 has two layers is illustrated. However, the above descriptions are similarly applied to a case where the collected toner Tc held on the surface of the cleaning roll 81 has three or more layers.

Next, in a case where the adhesive force Fcln of the collected toner Tc to the surface of the cleaning roll 81 is larger than the cohesive force Ftn of the collected toner Tc and is larger than the adhesive force Fhr of the collected toner Tc to the surface of the heating roll 41 (Fcln>Ftn and Fcln>Fhr), the collected toner Tc held on the surface of the cleaning roll 81 continuously adheres to the surface of the cleaning roll 81 even after coming into contact with the surface of the heating roll 41 at the cleaning position, as illustrated in FIG. 12.

Figure 13:
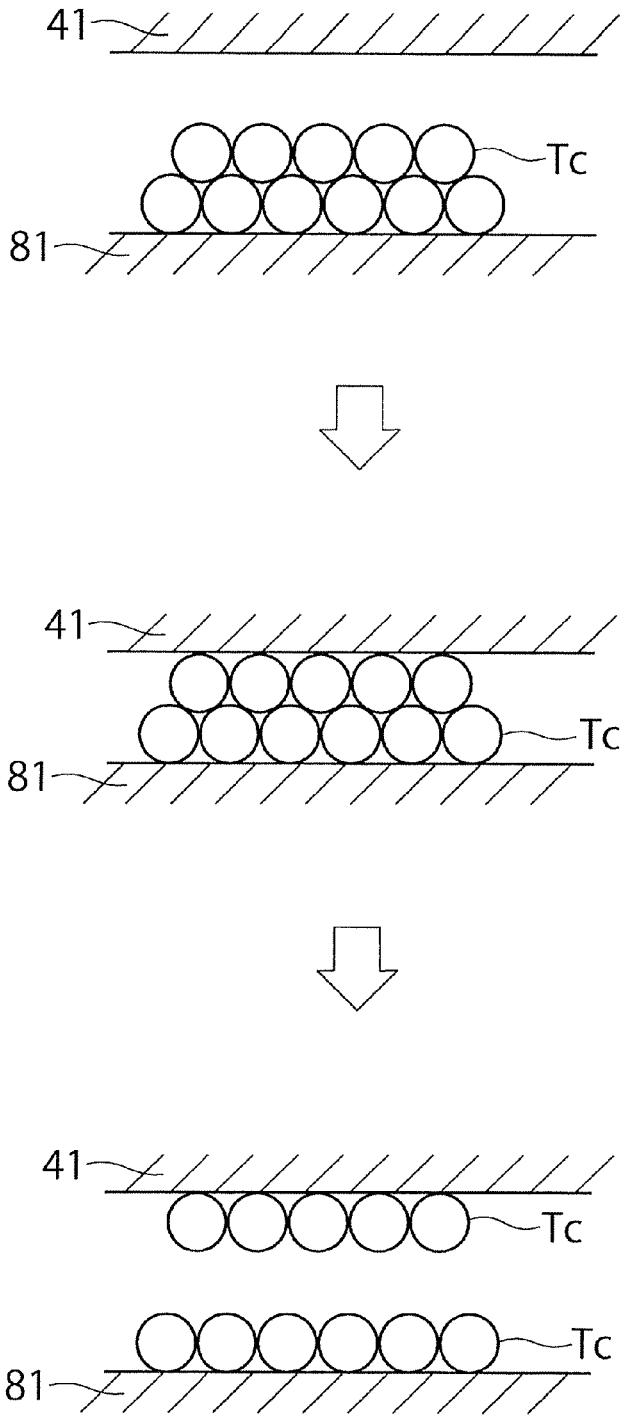
FIG. 13 is a diagram illustrating the adhesion state of the toner to the surfaces of the heating roll and the cleaning roll.

In a case where the adhesive force Fhr of the collected toner Tc to the surface of the heating roll 41 is larger than the cohesive force Ftn of the collected toner Tc and is smaller than the adhesive force Fcln of the collected toner Tc to the surface of the cleaning roll 81 (Fhr>Ftn and Fcln>Fhr), when only the uppermost toner of the collected toner Tc held on the surface of the cleaning roll 81 comes into contact with the surface of the heating roll 41 at the cleaning position as illustrated in FIG. 13, the uppermost toner is reversely transferred to the surface of the heating roll 41.

Figure 14:
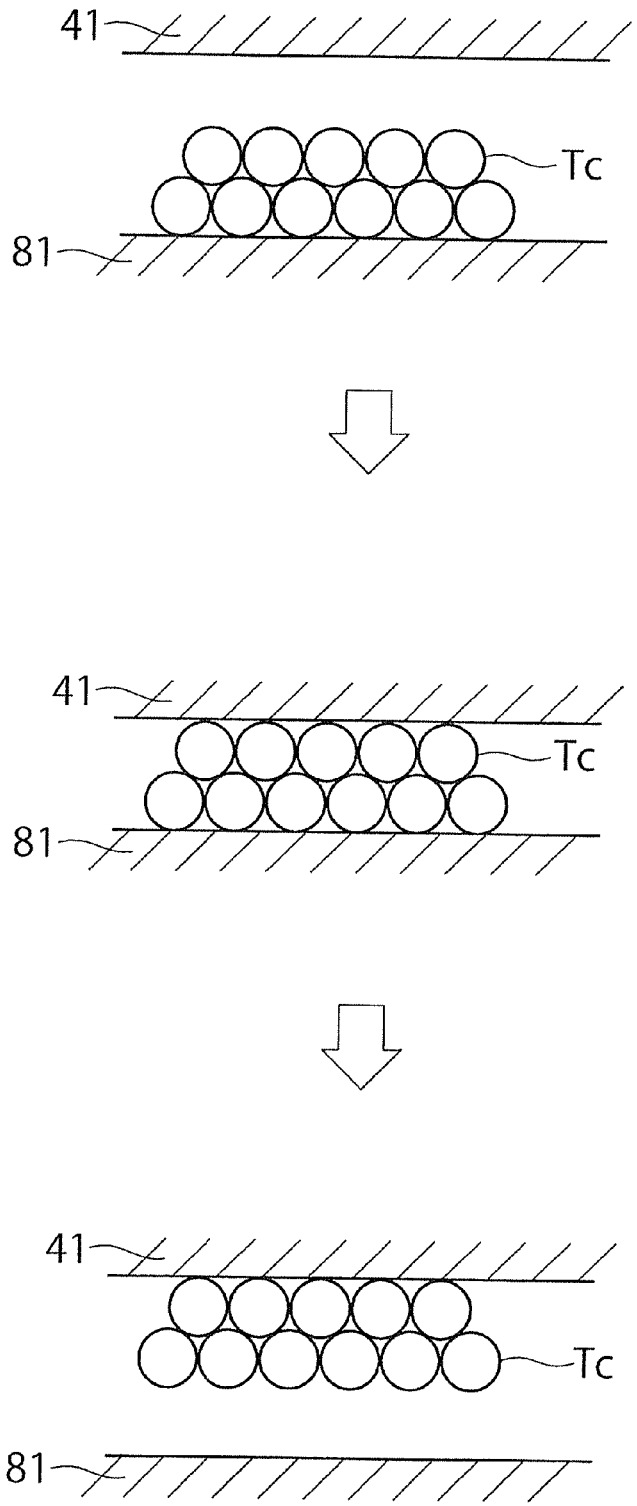
FIG. 14 is a diagram illustrating the adhesion state of the toner to the surfaces of the heating roll and the cleaning roll.

Further, in a case where the adhesive force Fhr of the collected toner Tc to the surface of the heating roll 41 is larger than the cohesive force Ftn of the collected toner Tc and is larger than the adhesive force Fcln of the collected toner Tc to the surface of the cleaning roll 81 (Fhr>Ftn and Fhr>Fcln), when the collected toner Tc held on the surface of the cleaning roll 81 comes into contact with the surface of the heating roll 41 at the cleaning position as illustrated in FIG. 14, the entirety of the collected toner Tc held on the surface of the cleaning roll 81 is reversely transferred to the surface of the heating roll 41.

As described above, the heating roll 41 is heated by the halogen lamps 414*a* and 414*b* arranged in the heating roll 41, and thus the surface temperatures of the cleaning roll 81 and the collecting roll 82, further, the temperatures of the collected toner Tc adhering to the surfaces of the heating roll 41, the cleaning roll 81, and the collecting roll 82 are changed by heat conduction from the heating roll 41. Thus, if the collected toner Tc adhering to the surfaces of the cleaning roll 81 and the collecting roll 82 is transferred to the heating roll 41, and then the cleaning operation of causing the recording paper 5 formed with plain paper as the cleaning material to pass through the fixing nip portion N, it is possible to remove the collected toner Tc adhering to the surfaces of the cleaning roll 81 and the collecting roll 82.

Paper dust may be mixed in the collected toner Tc depending on the peeling of an external additive 305 or the material of the recording paper 5, but the basic physical properties of the collected toner Tc are similar to those of a new toner T. In a case where the amount of paper dust contamination from the recording paper 5 is large, physical properties of the collected toner Tc, such as the cohesive force or the adhesive force, may be changed, and the cohesive force or the adhesive force tends to increase with increasing the amount of the paper dust contamination. This is apparent by the present discloser.

Although the cohesive force Ftn of the collected toner also depends on components such as a synthetic resin constituting the toner, even in a case where the components such as the synthetic resin constituting the toner are different, the same relation as that illustrated in FIG. 7 is shown.

As a result, even in a case where the type of toner T used in the image forming apparatus 1 is different, and the configuration of the fixing device 40 is different, since the surface temperature of the heating roll 41 is set to a temperature higher than the temperature at which the cohesive force Ftn of the collected toner Tc is smaller than the adhesive force Fhr of the toner to the heating roll 41, the collected toner Tc adhering to the outer circumferential surfaces of the cleaning roll 81 and the collecting roll 82 is reversely transferred (discharged) to the surface of the heating roll 41.

In the first exemplary embodiment, for example, the surface temperature of the heating roll 41 as the temperature higher than the temperature at which the cohesive force Ftn of the collected toner Tc is smaller than the adhesive force Fhr of the toner to the heating roll 41 is set to 210° C. The surface temperature of the heating roll 41 is not limited to 210° C. The surface temperature of the heating roll 41 may be higher than the temperature at which the cohesive force Ftn of the collected toner is smaller than the adhesive force Fhr of the toner to the heating roll 41, and may be set to 205° C., 215° C., 220° C., or the like. If the surface temperature of the heating roll 41 is equal to or higher than 230° C., the heating roll 41, the press belt 42, or other members constituting the fixing device 40 may be thermally damaged over time. Thus, the surface temperature of the heating roll 41 is desirably equal to or lower than 220° C.

Operation of Fixing Device

In the fixing device 40 according to the first exemplary embodiment, when a predetermined condition that it is determined that there is a possibility of exceeding the allowable amount of the collected toner which can be held by the cleaning device 80 is satisfied, a recovery (discharging) mode of discharging the collected toner obtained by cleaning of the cleaning device 80 and brining the cleaning device 80 back to a reusable state is performed. The recovery mode is performed when a predetermined condition is satisfied and after the previous image forming operation is completed or before the next image forming operation is started.

The control device 100 determines whether it is time to perform the recovery mode. As a timing for performing the recovery mode, for example, a time when jam of the recording paper 5 occurs in the fixing device 40, a time when borderless printing is cumulatively performed on predetermined sheets or more of the recording paper 5, a time when the fixing operation is cumulatively performed on predetermined sheets or more of embossed paper, and the like are set. The recovery mode is not limited thereto, and may be performed in a case where other conditions are satisfied, or may be performed by a user operation. The control device 100 has, for example, a function of determining and counting the type of the recording paper 5 and the cumulative number of sheets of the recording paper 5.

When jam being transport failure of the recording paper 5 occurs, the control device 100 determines whether or not a region in which the jam of the recording paper 5 occurs is a region of the fixing device 40. Here, whether or not the region in which the jam occurs is the region of the fixing device 40 is determined based on whether or not the recording paper 5 holding the unfixed toner image Ti is positioned at the fixing nip portion N of the fixing device 40.

If the control device 100 determines that it is time to perform the recovery mode, the control device 100 performs the recovery operation as follows.

In the recovery mode, as illustrated in FIG. 3, the control device 100 energizes the halogen lamps 414*a* and 414*b* of the heating roll 41 to heat the surface temperature of the heating roll 41 to reach a required temperature (for example, 210° C.). At this time, the heating roll 41 is rotationally driven at a normal rotation speed.

Figure 15:
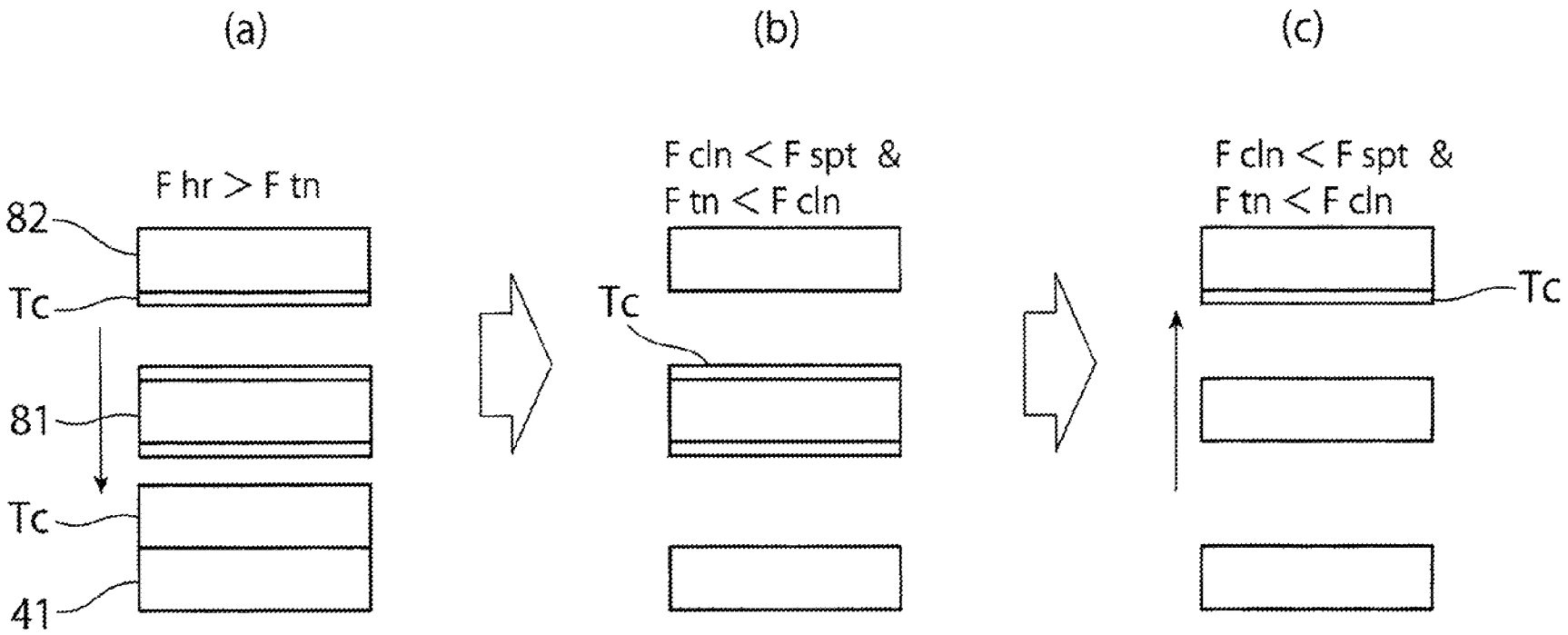
FIG. 15 is a configuration diagram illustrating an action of the fixing device according to the first exemplary embodiment of the present disclosure.

As illustrated in (a) of FIG. 15, if the control device 100 determines that the surface temperature of the heating roll 41 has reached the required temperature (for example, 210° C.), the control device 100 controls the heating roll 41 to continuously rotate and drive at the normal rotation speed for a predetermined time (for example, about 1 to 2 minutes). In this high-temperature rotating operation, the surface temperature of the heating roll 41 is desirably set to a temperature higher than the temperature in fixing over the entire region through which the recording paper 5 of the maximum size passes in the direction intersecting with the rotation direction of the heating roll 41. However, it is not necessary to cover the entire region, and a region portion in the direction intersecting with the rotation direction of the heating roll 41 may have a temperature higher than the temperature in fixing.

At this time, in the fixing device 40, when the surface temperature of the heating roll 41 reaches the required temperature (for example, 210° C.), the cleaning roll 81 coming into contact with the surface of the heating roll 41 and the collecting roll 82 coming into contact with the cleaning roll 81 are also heated to a temperature (for example, 210° C.) which is the same as the surface temperature of the heating roll 41, by heat conduction.

If the cleaning roll 81 and the collecting roll 82 are heated, as illustrated in FIG. 7, regarding the collected toner Tc held on the surfaces of the collecting roll 82 and the cleaning roll 81, the cohesive force Ftn of the collected toner is smaller than the adhesive forces Fhr, Fcln, and Fspt of the collected toner Tc to the surfaces of the heating roll 41, the cleaning roll 81, and the collecting roll 82.

As a result, the collected toner Tc held on the surface of the collecting roll 82 is transferred to the surface of the cleaning roll 81, and the collected toner Tc transferred to the surface of the cleaning roll 81 is reversely transferred to the surface of the heating roll 41. Thus, the collected toner Tc held on the surfaces of the collecting roll 82 and the cleaning roll 81 is reversely transferred to the surface of the heating roll 41 while the heating roll 41 is rotationally driven for a required time.

At this time, as illustrated in FIG. 7, the adhesive force Fcln of the collected toner Tc to the surface of the cleaning roll 81 is larger than the cohesive force Ftn of the collected toner. Therefore, as illustrated in (a) of FIG. 15, a thin layer (about one or two layers) of the collected toner Tc remains on the surface of the cleaning roll 81 by the adhesive force Fcln of the collected toner Tc.

Then, the control device 100 controls energization to the halogen lamps 414*a* and 414*b* of the heating roll 41 to lower the surface temperature of the heating roll 41 to a normal fixing temperature (for example, 170 to 190° C.).

As illustrated in (b) of FIG. 15, if the control device 100 determines that the surface temperature of the heating roll 41 has reached the normal fixing temperature (for example, 170 to 190° C.), the control device 100 performs the cleaning operation in which plural sheets (for example, about 5) of recording paper 5 are automatically fed from the paper feeding device 50, or a user is urged to feed plural sheets (for example, about 5) of recording paper 5 from the manual paper feeding device 70 by displaying a message in an operation display unit (not illustrated), and thus the recording paper 5 is caused to pass through the fixing nip portion N of the fixing device 40.

With the cleaning operation, as illustrated in (b) of FIG. 15, the collected toner Tc which has reversely transferred to the surface of the heating roll 41 adheres to the plural sheets of recording paper 5 at the fixing nip portion N. In this manner, cleaning of the surface of the heating roll 41 is performed.

Here, the reason that the surface temperature of the heating roll 41 is set to the normal fixing temperature (for example, 170 to 190° C.) is to prevent an occurrence of a situation in which, in a case where the surface temperature of the heating roll 41 is switched to a temperature lower than the normal fixing temperature, the adhesive force Fspt of the collected toner Tc to the surface of the collecting roll 82 is larger than the cohesive force Ftn of the collected toner, and thus the collected toner Tc adhering to the surface of the cleaning roll 81 to be a thin layer is transferred to the collecting roll 82.

Then, the control device 100 controls energization to the halogen lamps 414*a* and 414*b* of the heating roll 41, and lowers the surface temperature of the heating roll 41 to a temperature (for example, about 140° C.) lower than the normal fixing temperature. In FIG. 7, the low temperature is a temperature at which the cohesive force Ftn of the collected toner is larger than the adhesive force Fspt of the collected toner Tc to the surface of the collecting roll 82.

As illustrated in (c) of FIG. 15, if the control device 100 determines that the surface temperature of the heating roll 41 has reached the temperature (for example, about 140° C.) lower than the normal fixing temperature, the control device 100 controls the heating roll 41 to continuously rotate and drive at the normal rotation speed for a predetermined time (for example, about two minutes) which is longer than that in rotation at a high temperature. In this low-temperature rotating operation, the surface temperature of the heating roll 41 is desirably set to a temperature lower than the temperature in fixing over the entire region through which the recording paper 5 of the maximum size passes in the direction intersecting with the rotation direction of the heating roll 41. However, it is not necessary to cover the entire region, and a region portion in the direction intersecting with the rotation direction of the heating roll 41 may have a temperature lower than the temperature in fixing.

If the surface temperature of the heating roll is set to a low temperature, the collected toner Tc remaining on the surfaces of the heating roll 41 and the cleaning roll 81 is transferred from the heating roll 41 to the cleaning roll 81 and is further transferred from the cleaning roll 81 to the collecting roll 82. The collected toner Tc transferred to the collecting roll 82 is held on the outer circumferential surface of the collecting roll 82.

At this time, the collected toner Tc remaining on the surfaces of the heating roll 41 and the cleaning roll 81 is very small. Thus, the entirety of the remaining toner is transferred from the cleaning roll 81 to the collecting roll 82, and then is held on the outer circumferential surface of the collecting roll 82 by the adhesive force Fcln and the cohesive force Ftn of the toner transferred to the outer circumferential surface of the collecting roll 82 and is not transferred to the cleaning roll 81.

As described above, according to the fixing device 40 according to the first exemplary embodiment, it is possible to improve the removability of the collected toner Tc held by the cleaning roll 81 and the collecting roll 82 and to continuously use the fixing device 40, in comparison to a case where the temperature when the recovery mode is idle is equal to or lower than the temperature when the image is fixed.

Second Exemplary Embodiment

Figure 16:
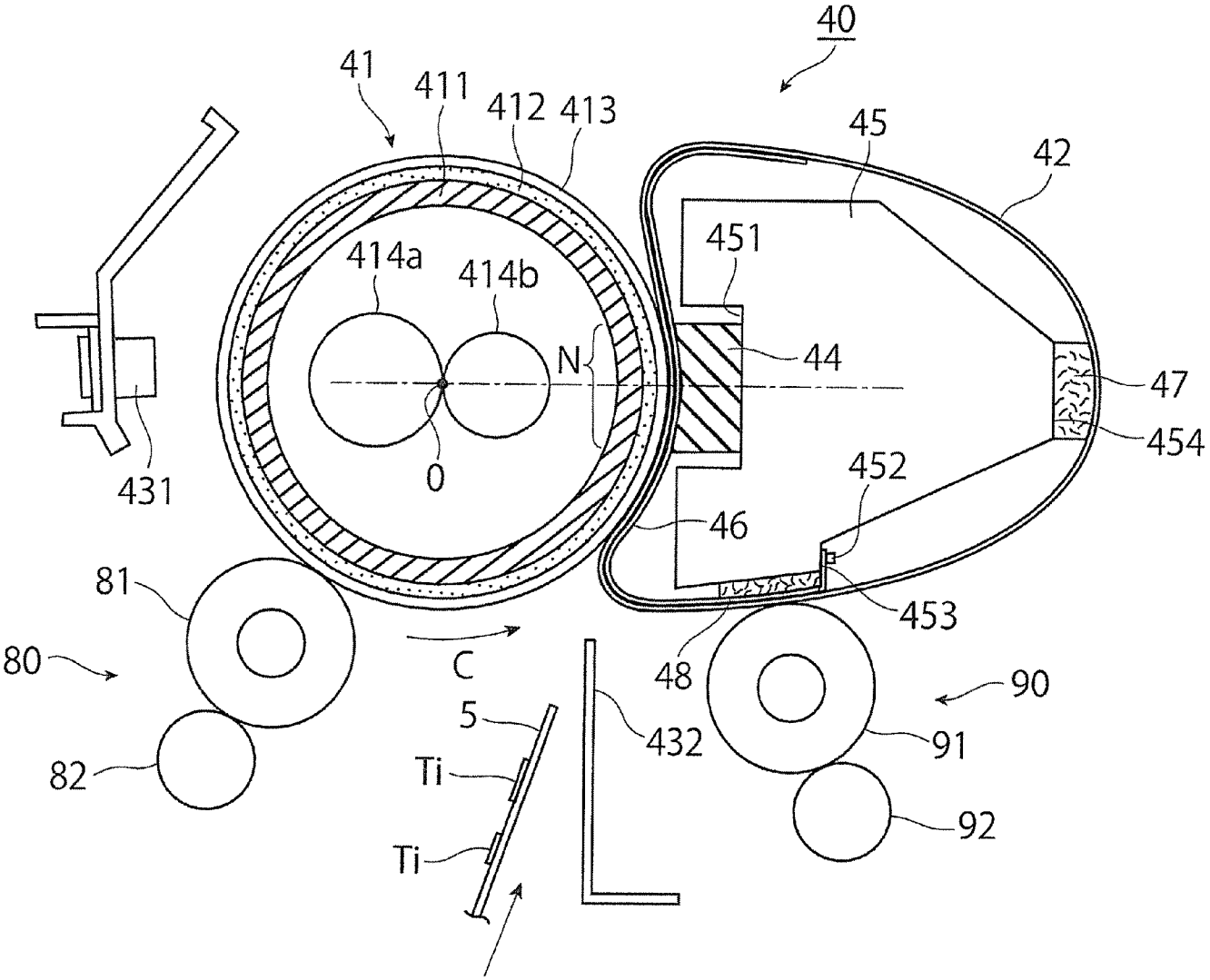
FIG. 16 is a configuration diagram illustrating a main part of a fixing device according to a second exemplary embodiment of the present disclosure.

FIG. 16 illustrates a fixing device according to a second exemplary embodiment. In the fixing device according to the second exemplary embodiment, the cleaning device is provided not only for the heating roll but also for the press belt.

That is, in the fixing device 40 according to the second exemplary embodiment, a second cleaning device 90 is provided on the outer circumferential surface of the press belt 42, as illustrated in FIG. 16. The second cleaning device 90 includes a cleaning roll 91 as an example of the first cleaning unit and a collecting roll 92 as an example of the second cleaning unit. The cleaning roll 91 comes into contact with the surface of the press belt 42 at required pressing force. The collecting roll 92 comes into contact with the surface of the cleaning roll 91 at required pressing force. The cleaning roll 91 is disposed in the vicinity of the lower end portion in the figure, which is close to the fixing nip portion N, on the outer circumferential surface of the press belt 42.

The cleaning roll 91 and the collecting roll 92 are configured similar to the cleaning roll 81 and the collecting roll 82.

An elastic material 48 made of felt or the like is provided on the back surface of the press belt 42 with which the cleaning roll 91 comes into press-contact.

As described above, since the second cleaning device 90 is provided for the press belt 42, the toner or the like adhering to the surface of the press belt 42 is transferred to the heating roll 41 once. Then, the toner can be immediately removed by the second cleaning device 90 of the press belt 42, not be removed by the cleaning device 80 of the heating roll 41.

Other configurations and operations are the same as those in the above-described exemplary embodiment, and thus description thereof will be omitted.

Third Exemplary Embodiment

Figure 17:
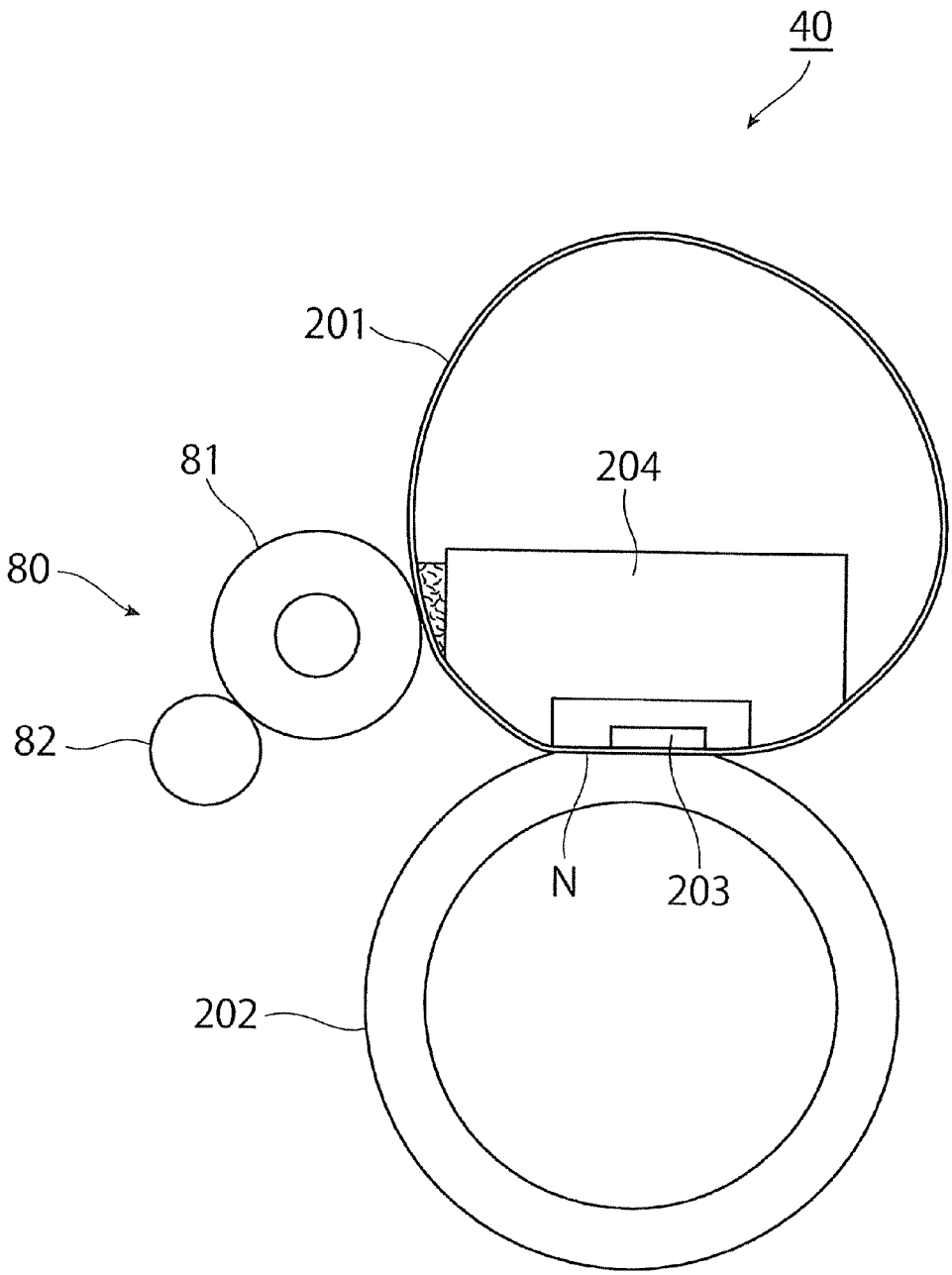
FIG. 17 is a schematic sectional diagram illustrating a fixing device according to a third exemplary embodiment of the present disclosure.

FIG. 17 illustrates a fixing device according to a third exemplary embodiment. In the fixing device 40 according to the third exemplary embodiment, a heating belt is used as a first pressing unit, and a pressure roll is used as a second pressing unit.

That is, as illustrated in FIG. 17, the fixing device 40 according to the third exemplary embodiment includes a heating belt 201 as an example of an endless belt, and a pressure roll 202. The cleaning device 80 is provided in the heating belt 201.

A pressing member 204 including a heating unit 203 is disposed in the heating belt 201. The heating belt 201 is pressed by the pressing member to form a fixing nip portion N between the heating belt 201 and the pressure roll.

A pressing member including a heating unit is disposed in the heating belt 201. The heating belt 201 is pressed by the pressing member 204 to form a fixing nip portion N between the heating belt 201 and the pressure roll 202.

Other configurations and operations are the same as those in the above-described exemplary embodiment, and thus description thereof will be omitted.

In the above exemplary embodiments, the full-color image forming apparatus in which the image forming unit includes the plural image forming devices and the intermediate transfer device are described. However, the present disclosure is not limited thereto, and the above exemplary embodiments can be applied to a monochrome image forming apparatus including a single image forming device.

In the above exemplary embodiments, a case where the roll or the belt is used as the first pressing unit, and the belt or the roll is used as the second pressing unit is described. However, belts may be used as the first and second pressing units, or rolls may be used as the first and second pressing units.

Furthermore, in the above exemplary embodiments, a case where the heating unit is provided in the first pressing unit is described. However, the heating unit may be provided in both the first and second pressing units.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first pressing unit that rotates;

a second pressing unit that comes into press-contact with the first pressing unit to form a nip portion at which a toner image is fixed on a recording medium;

a heating unit that heats at least one of the first and second pressing units; and a first cleaning unit that comes into contact with a surface of at least one of the first and second pressing units to perform cleaning, the fixing device being configured to perform a high-temperature rotating operation that includes rotating the first or second pressing unit and heating a surface of the first or second pressing unit coming into contact with the first cleaning unit to a temperature higher than a temperature during fixing; and then to perform a cleaning operation that includes causing a cleaning material to pass through the nip portion.

2. The fixing device according to claim 1, wherein the temperature higher than the temperature during fixing is a temperature at which a toner subjected to cleaning by the first cleaning unit has a cohesive force smaller than an adhesive force of the toner to the first or second pressing unit coming into contact with the first cleaning unit.

3. The fixing device according to claim 2, wherein a rotation speed in the high-temperature rotating operation is lower than a highest speed during the fixing.

4. The fixing device according to claim 1, wherein the temperature of the surface of the first or second pressing unit coming into contact with the first cleaning unit in the high-temperature rotating operation is higher than the temperature during fixing over a region through which the recording medium having a maximum size along a direction intersecting with a rotation direction of the first and second pressing units passes.

5. The fixing device according to claim 4, wherein the temperature of the surface of the first or second pressing unit coming into contact with the first cleaning unit in the cleaning operation is lower than the temperature in the high-temperature rotating operation.

6. The fixing device according to claim 5, which is further configured to cause the cleaning material to pass through the nip portion after the temperature of the surface of the first or second pressing unit coming into contact with the first cleaning unit becomes lower than the temperature in the high-temperature rotating operation after the high-temperature rotating operation.

7. The fixing device according to claim 1, which is further configured to perform a low-temperature rotating operation that includes rotating the first or second pressing unit coming into contact with the first cleaning unit at a temperature lower than the temperature in the high-temperature rotating operation, after the cleaning material passes through the nip portion.

8. The fixing device according to claim 1, further comprising:

a second cleaning unit that comes into contact with the first cleaning unit to perform cleaning, wherein the first cleaning unit has a surface made of a rubber material, and the second cleaning unit has a surface made of a metal material.

9. The fixing device according to claim 8, wherein the toner has adhesive forces to the first pressing unit, the second pressing unit, the first cleaning unit, and the second cleaning unit during the fixing so as to satisfy the relation: the adhesive force to the second cleaning unit>the adhesive force to the first cleaning unit>the adhesive force to the first and second pressing units.

10. An image forming apparatus comprising:

an image forming unit that forms a toner image on a recording medium; and a fixing unit that fixes the toner image formed on the recording medium and includes the fixing device according to claim 1.

* * * * *